US007626501B2

(12) United States Patent
Feibelman

(10) Patent No.: US 7,626,501 B2
(45) Date of Patent: Dec. 1, 2009

(54) ANTI-THEFT TAG

(75) Inventor: Jeffrey A. Feibelman, Providence, RI (US)

(73) Assignee: Display Technologies, Inc., Johnston, RI (US)

( * ) Notice: Subject to any disclaimer, the term of this patent is extended or adjusted under 35 U.S.C. 154(b) by 268 days.

(21) Appl. No.: 11/787,278

(22) Filed: Apr. 16, 2007

(65) Prior Publication Data

US 2007/0285243 A1 Dec. 13, 2007

Related U.S. Application Data

(63) Continuation of application No. 10/977,058, filed on Oct. 29, 2004, now Pat. No. 7,227,467, which is a continuation-in-part of application No. 10/853,489, filed on May 25, 2004, now Pat. No. 7,129,841, which is a continuation-in-part of application No. 10/696,483, filed on Oct. 29, 2003, now Pat. No. 6,933,847.

(51) Int. Cl.
*G08B 13/14* (2006.01)

(52) U.S. Cl. ..... 340/568.2; 340/568.1; 340/571

(58) Field of Classification Search ..... 340/586.1, 340/568.2, 568.3, 568.4, 568.7, 571, 572.1, 340/572.8, 572.9; 70/18, 49
See application file for complete search history.

(56) References Cited

U.S. PATENT DOCUMENTS

| | | | | |
|---|---|---|---|---|
| 3,065,946 | A | 11/1962 | Berkow | 248/317 |
| 3,253,270 | A | 5/1966 | Downer | 340/280 |
| 3,911,534 | A | 10/1975 | Martens et al. | 24/150 R |
| 3,961,431 | A | 6/1976 | Kalenian | 40/21 R |
| 4,506,415 | A | 3/1985 | Swift | 24/16 PB |
| 4,580,319 | A | 4/1986 | Paradis | 24/16 PB |
| 4,588,218 | A | 5/1986 | Guiler et al. | 292/307 R |
| 4,746,909 | A | 5/1988 | Israel et al. | 340/586 |
| 4,875,647 | A | 10/1989 | Takagi et al. | 248/74.3 |

(Continued)

FOREIGN PATENT DOCUMENTS

| | | |
|---|---|---|
| FR | 2 713 379 | 6/1995 |

(Continued)

OTHER PUBLICATIONS

U.S. Appl. No. 11/347,736, filed Feb. 3, 2006, by Jeffrey A. Feibelman, Norman Thibaudeau, William Duarte, and David Miller, entitled Rotating Anti-Theft Tag.

*Primary Examiner*—Van T. Trieu

(57) ABSTRACT

An anti-theft security tag includes an engagement member having a first and second end securable within a housing by a crimping member for attachment to an article. In one embodiment, the housing supports an electronic article surveillance marker and may include a channel for receiving and securing at least one self crimping member. The self crimping member is sized to receive one end of the engagement member. The one or more crimping members may be disc shaped, including a plurality of fingers for securing one end of the engagement member, or may have a variety of other shapes. The self crimping members allow the engagement member to be moved downward, but not upward, so as to make the engagement loop smaller. In another embodiment, the crimping member is manual and a slot is disposed within the housing in alignment with the at least one crimping member, and is sized to receive a crimping tool to crimp the member and secure the line to the article within the housing.

22 Claims, 38 Drawing Sheets

U.S. PATENT DOCUMENTS

| | | | | | |
|---|---|---|---|---|---|
| 4,962,369 | A | | 10/1990 | Close | 340/572 |
| 5,079,540 | A | | 1/1992 | Narlow et al. | 340/572 |
| 5,099,228 | A | | 3/1992 | Israel et al. | 340/572 |
| 5,120,097 | A | | 6/1992 | Fattori et al. | 292/318 |
| 5,293,668 | A | | 3/1994 | Tibiletti | 24/16 PB |
| 5,337,503 | A | | 8/1994 | Goby et al. | 40/665 |
| 5,421,177 | A | | 6/1995 | Sieber et al. | 70/57.1 |
| 5,437,172 | A | | 8/1995 | Lamy et al. | 70/57.1 |
| 5,513,421 | A | | 5/1996 | Wells | 24/16 PB |
| 5,524,463 | A | | 6/1996 | Schenkel et al. | 70/57.1 |
| 5,570,080 | A | | 10/1996 | Inoue et al. | 340/571 |
| 5,689,237 | A | | 11/1997 | Sasagawa et al. | 340/568 |
| 5,717,382 | A | | 2/1998 | Cooper | 340/572 |
| 5,722,266 | A | * | 3/1998 | Yeager et al. | 70/57 |
| 5,754,108 | A | | 5/1998 | Ungarsohn | 340/568 |
| 5,794,464 | A | * | 8/1998 | Yeager et al. | 70/57 |
| 5,883,576 | A | | 3/1999 | De La Huerga | 340/573.1 |
| 5,945,909 | A | | 8/1999 | Kolton | 340/572.1 |
| 5,949,336 | A | | 9/1999 | Deschenes et al. | 340/572.8 |
| 5,969,613 | A | | 10/1999 | Yeager et al. | 340/572.9 |
| 5,977,877 | A | | 11/1999 | McCulloch et al. | 340/572.8 |
| 6,002,343 | A | * | 12/1999 | Auerbach et al. | 340/10.41 |
| 6,052,876 | A | | 4/2000 | Hogan et al. | 24/704.1 |
| 6,064,306 | A | | 5/2000 | Deschenes et al. | 340/572.8 |
| 6,078,258 | A | * | 6/2000 | Auerbach et al. | 340/568.2 |
| 6,092,401 | A | | 7/2000 | Sankey et al. | 70/18 |
| 6,128,932 | A | | 10/2000 | Mainetti et al. | 70/57.1 |
| 6,188,320 | B1 | | 2/2001 | Kolton et al. | 340/572.9 |
| 6,226,839 | B1 | | 5/2001 | Sayegh | 24/16 PB |
| 6,243,005 | B1 | | 6/2001 | Haimovich et al. | 340/427 |
| 6,255,950 | B1 | | 7/2001 | Nguyen | 340/572.8 |
| 6,308,539 | B1 | | 10/2001 | Kolton et al. | 70/57.1 |
| 6,311,531 | B1 | | 11/2001 | Sykes | 50/57.1 |
| 6,326,890 | B1 | | 12/2001 | Costa | 340/572.9 |
| 6,343,819 | B1 | | 2/2002 | Shiozaki | 292/307 R |
| 6,373,390 | B1 | | 4/2002 | Hogan et al. | 340/572.8 |
| 6,389,853 | B1 | | 5/2002 | Pate et al. | 70/18 |
| 6,433,686 | B1 | | 8/2002 | Feibelman | 340/572.8 |
| 6,446,474 | B1 | | 9/2002 | Tabacchi et al. | 70/16 |
| 6,476,717 | B1 | | 11/2002 | Gross et al. | 340/568.1 |
| 6,523,292 | B2 | | 2/2003 | Slavik | |
| 6,535,130 | B2 | | 3/2003 | Nguyen et al. | 340/572.9 |
| 6,567,003 | B2 | | 5/2003 | Kolton et al. | 340/572.8 |
| 6,578,394 | B2 | | 6/2003 | Yin | 70/58 |
| 6,624,753 | B2 | | 9/2003 | Elston | 340/572.8 |
| 6,755,055 | B2 | | 6/2004 | Sedon et al. | 340/572.9 |
| 2002/0154014 | A1 | | 10/2002 | Elston | 340/572.8 |
| 2003/0020613 | A1 | | 1/2003 | Cosnard | 340/572.8 |
| 2004/0074265 | A1 | | 4/2004 | Bruening et al. | 70/59 |
| 2005/0029702 | A1 | | 2/2005 | Deschenes et al. | |
| 2007/0029786 | A1 | | 2/2007 | Morgan | |

FOREIGN PATENT DOCUMENTS

| | | | |
|---|---|---|---|
| WO | 85/01981 | A | 5/1985 |
| WO | 94/04781 | A | 3/1994 |
| WO | WO 98/40591 | | 9/1998 |

* cited by examiner

ANTI-THEFT TAG

CROSS REFERENCES TO RELATED APPLICATIONS

This application is a continuation of U.S. Ser. No. 10/977,058 filed Oct. 29, 2004 (now U.S. Pat. No. 7,227,467), which is a continuation-in-part of U.S. Ser. No. 10/853,489 filed May 25, 2004 (now U.S. Pat. No. 7,129,841), which is a continuation-in-part of U.S. Ser. No. 10/696,483 filed Oct. 29, 2003 (now U.S. Pat. No. 6,933,847) entitled ANTI-THEFT TAG. The entire contents of the above applications are explicitly incorporated herein by reference in their entirety.

TECHNICAL FIELD

The invention relates generally to an anti-theft tags and, more specifically, to an anti-theft tag including an electronic article sensor disposed within a housing and having a crimping mechanism disposed within the housing for securing the tag to an article.

BACKGROUND

It is well known in the art to use electronic article surveillance (EAS) sensors in order to prevent the theft of consumer products. Such electronic sensors trigger an alarm if not detached or disarmed before the product is removed from the store. For many products, electronic sensors have been very effective in deterring theft. However, such sensors can be difficult to attach to certain products, for example jewelry, fishing reels, alcohol and other products, and can often be easily removed from such items even when attached. An example of a higher price item where the difficulty of attaching electronic sensors is prevalent is watches. Often sensors cannot be attached to watch bands because they can be easily slipped off one end, and if the sensors are overly large they can limit the customer's ability to try on the watch before purchasing. Thus, electronic sensors attached to products such as watches must not only be tamper resistant in the hands of the consumer, but should also not interfere with the consumer's ability to try on the product. In addition, it is desirable to have an anti-theft tag which can be readily attached to a variety of products so that a retailer can utilize a single tag with many, different products, which can be attached in a convenient manner, and which are tamper resistant so that the EAS sensor cannot be readily removed by the consumer. A variety of tags containing EAS sensors have been developed over the past years in an attempt to address these and other issues.

One such sensor is described in U.S. Pat. No. 6,188,320 to Kolton et al. The '320 patent discloses an article identification and surveillance tag having an article engaging loop (22) which is adjustable by pulling on end member (20*b*) which is accessible exteriorly of the tag body. The tag (10) includes a body formed of housings (12 and 14) which are joined together during use. A tail (20) includes a first tail end (20*a*) which is peripherally continuous with a first end of the housing (12) which defines loop (22) exteriorly of the housing. The tail (20) extends from the loop, into and through the housing and terminates in tail end piece (20*b*), which is accessible exteriorly of the tag (10). Housing (12) defines and interior channel (24), the walls of which are formed with facing ratchets (26 and 28). Secured to tail (20) interiorly of housing (12) is a collar (30) of pawl member (32). The outer walls of pawl member (32) are formed with teeth (34 and 36) which engage respectively with ratchets (26 and 28). The ratchets (26 and 28) and teeth (34 and 36), engage such that the pawl member (32) is moveable only in one direction, i.e., downwardly, so that the loop can only be made smaller. The ratchets and teeth thus from a one way clutch, which precludes upward movement of pawl member (32) while providing for downward movement of the pawl. In one embodiment, the tail (52) defines a loop (53) exteriorly of the housing, the tail extending from the loop and tail parts (52*a*, 52*b*), ends of which are joined inside member (52*c*), and which is accessible exteriorly of tag (42).

U.S. Pat. No. 6,128,932 to Mainetti et al. discloses an anti-shoplifting device including a housing having a lower half (2) and an upper half (3), and a ferromagnetic plate (4) which is inserted into an internal cavity (5) formed by the upper and lower halves after they have been joined. A flexible and/or elastic cord (8) is supported on an edge of the lower half (2) and includes a spike (9) having flexible tongues (10), the spike (9) being insertable in an irreversible manner into opening (7) of the lower half (2) in order to for a loop which is attachable to a product.

U.S. Pat. No. 5,437,172 to Lamy et. al. discloses an anti-theft device for eyeglasses including a plate (1) having a link (7) extending therefrom. The plate includes a slot (14) for inserting the free end portion (15) of the link (7) and has fastening means for retaining the end portion (15). The fastening means includes a block (16) supported on the plate (1). The link (7) is connected to the plate (1) by inserting the link into a slot (18) until a bulged portion (17) is in abutment. After the link (7) has been looped around the bridge of the frame of a pair of eyeglasses, it is then inserted into the slot (14) to be locked therein. The link is fastened by a pin (22) which is moveable perpendicularly to the link and which projects into one of the holes (10) of the link under the action of a spring (23).

While generally effective, the aforementioned devices and others available in the art can still be difficult to attach to a variety of products, and can often be tampered with by the consumer. Accordingly, there is continued development in the art in order to further improve anti-theft tags.

SUMMARY

In accordance with the present invention, there is provided an anti-theft security tag having an engagement member, for example a cable, plastic or nylon line, or wire, which includes a first and a second end securable within a housing for attachment to an article, for example a watch band or bottle. The housing preferably further includes a channel for receiving and supporting at least one crimping member, and further supports an electronic article surveillance marker. In one embodiment, the one or more crimping members are self-crimping such that they automatically secure one end of the engagement member upon insertion there through. The self-crimping members may preferably include a plurality of fingers or teeth which act to automatically crimp the engagement member upon insertion into the crimping members. In one embodiment, the one or more crimping members may be disc shaped members that are supported within a channel by one or more ledges. In another embodiment the crimping members may be tubular with a plurality of teeth disposed within the interior wall of the tube for crimping the engagement member. In yet another embodiment, one or more spring shaped members may be utilized having teeth disposed thereon for crimping the engagement member. In any case, the self-crimping members allow the engagement member to be moved downward, but not upward, so that the engagement loop preferably cannot be removed by a consumer without breaking the loop. In another embodiment, the crimping member is not self-crimping, but instead is crimped by utilizing a crimping tube for engaging the crimping member. In such an embodiment, a slot may preferably be disposed within the housing for receiving the crimping tool in order to crimp the at least one crimping member, for example a tubular member, to attach and secure the wire to the article, and within the housing. In either the self-crimping or manual crimping embodiment, a wall or stop member may be disposed within the housing in order to prevent the insertion end of the engagement member from being over-inserted within the body. In this manner, the size of the engagement loop can also be predetermined as not being any smaller than the distance to the stop member will allow. Alternatively, an exit hole may be provided for allowing adjustment of the size of the engagement loop that is formed. The anti-theft tags disclosed herein can be readily assembled and are tamper resistant after assembly, as described in greater detail below.

BRIEF DESCRIPTION OF THE DRAWINGS

It should be understood that the drawings are provided for the purpose of illustration only and are not intended to define the limits of the invention. The foregoing and other objects and advantages of the embodiments described herein will become apparent with reference to the following detailed description when taken in conjunction with the accompanying drawings in which.

DETAILED DESCRIPTION OF THE ILLUSTRATIVE EMBODIMENT

Figure 1:
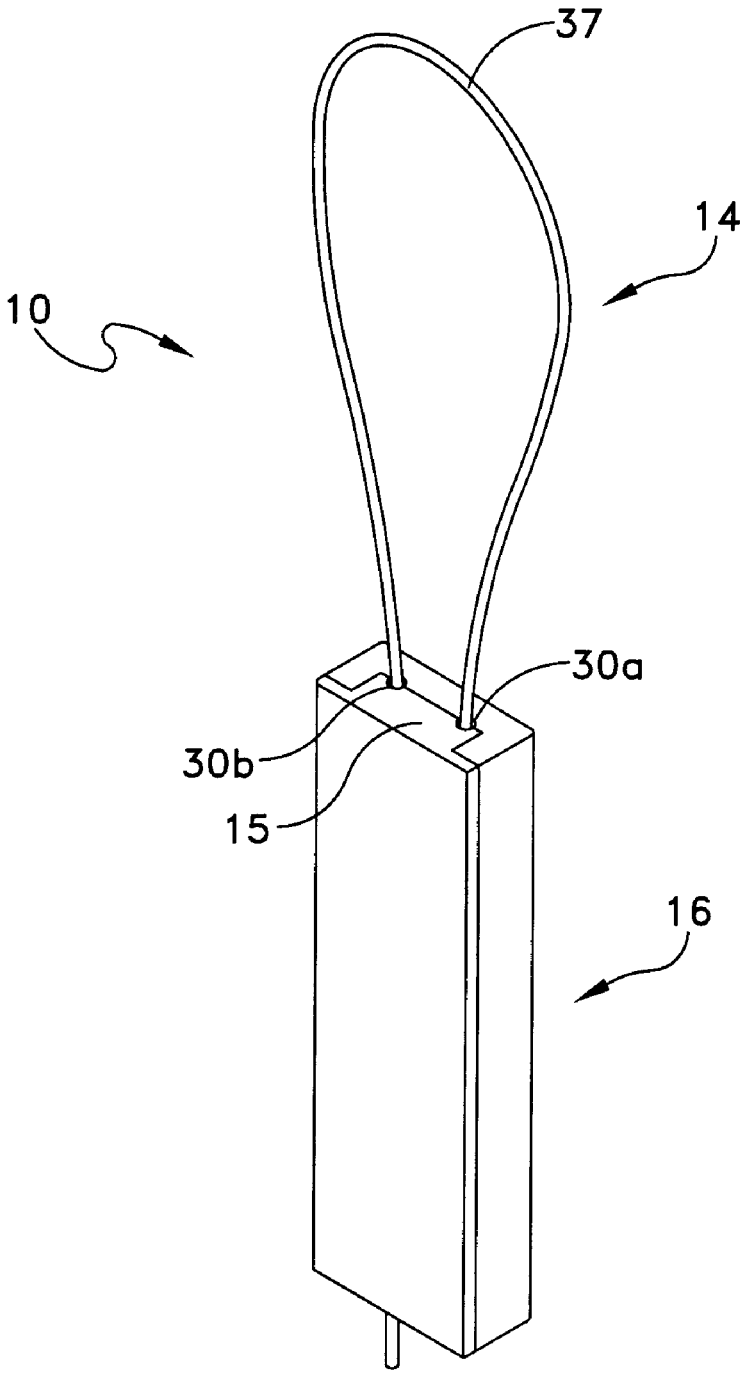
FIG. 1 is a perspective view of an anti-theft tag according to a first embodiment.
Figure 2:
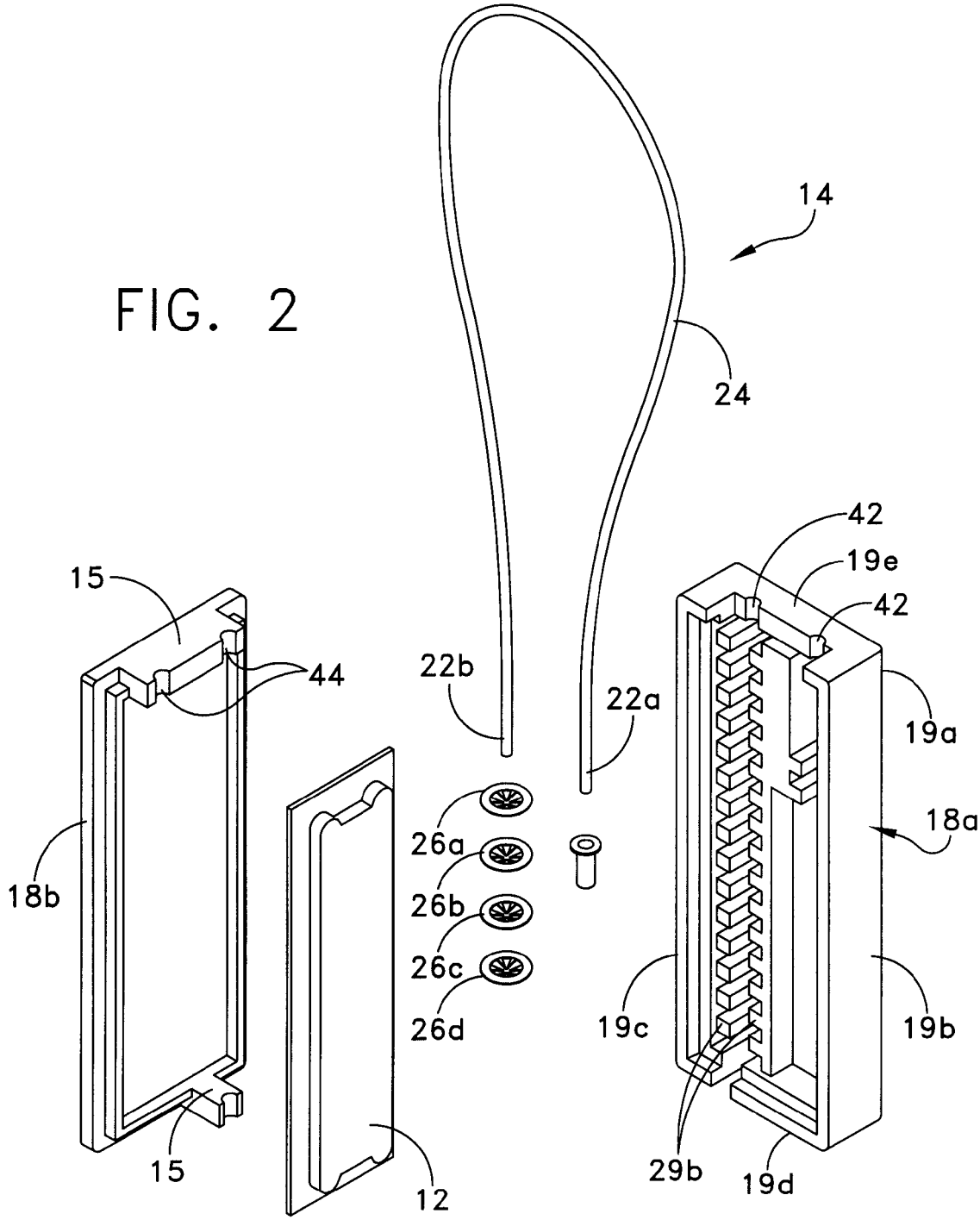
FIG. 2 is an exploded view of the anti-theft tag of FIG. 1.
Figure 3:
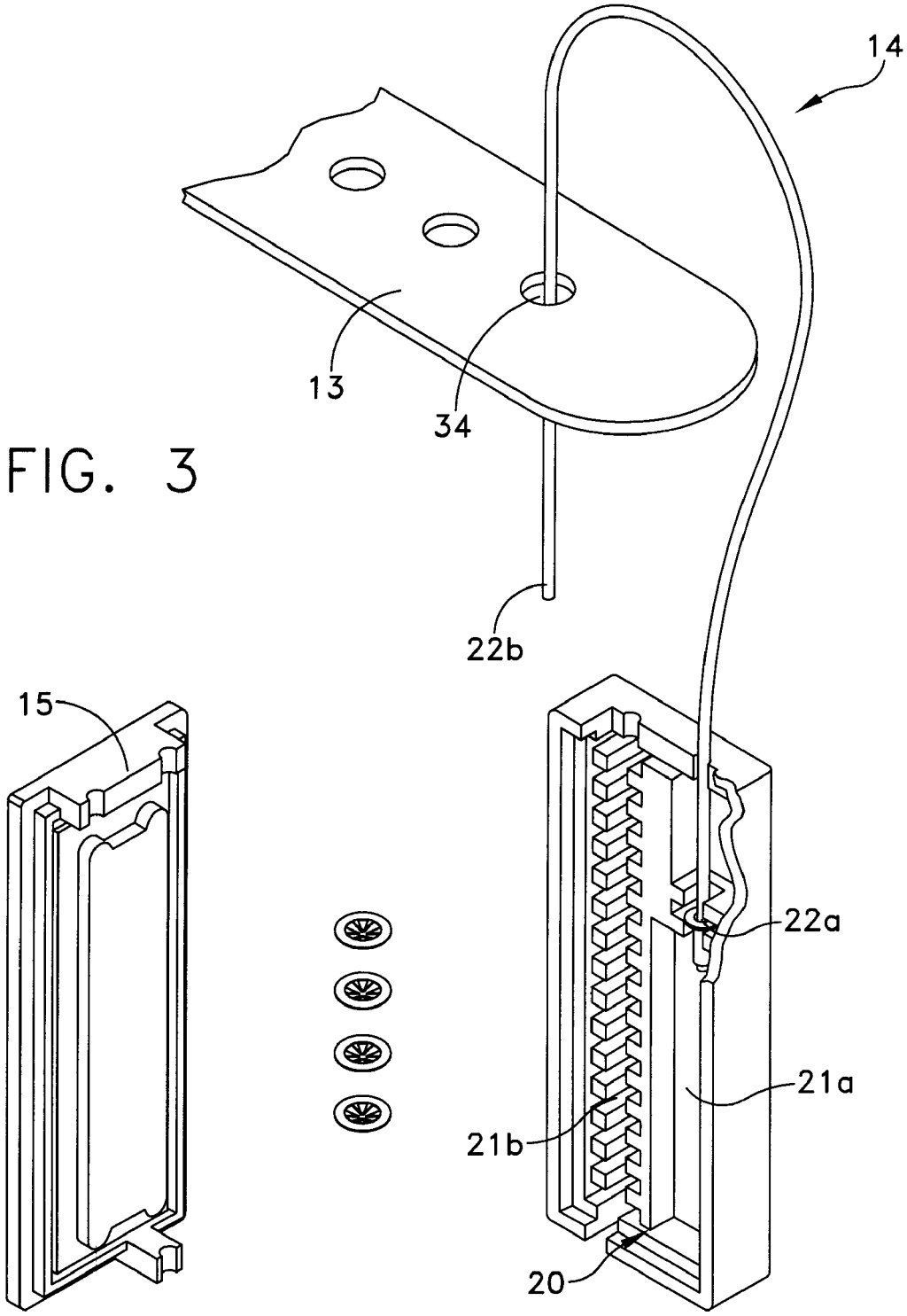
FIG. 3 is a perspective view of the anti-theft tag of FIG. 1 with the housing cover separated from the housing body.
Figure 4:
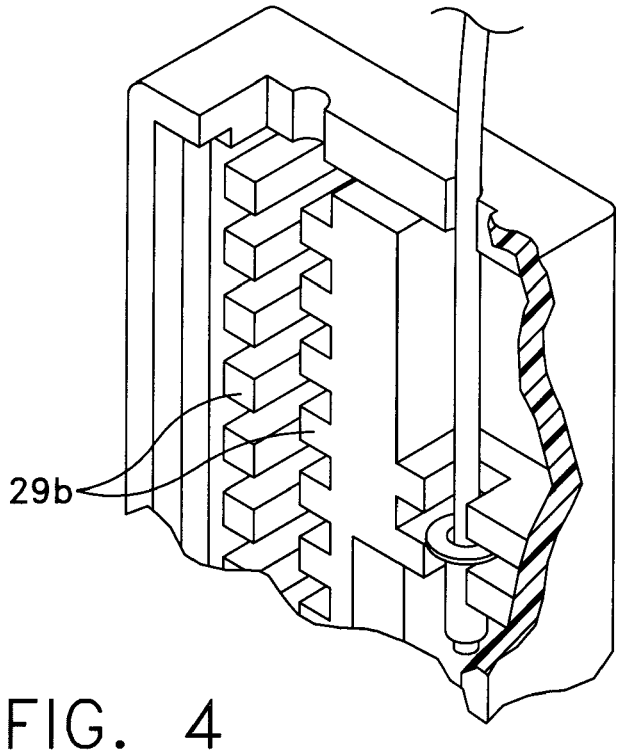
FIG. 4 is an enlarged perspective view of the top section of the housing body of FIG. 3.
Figure 5:
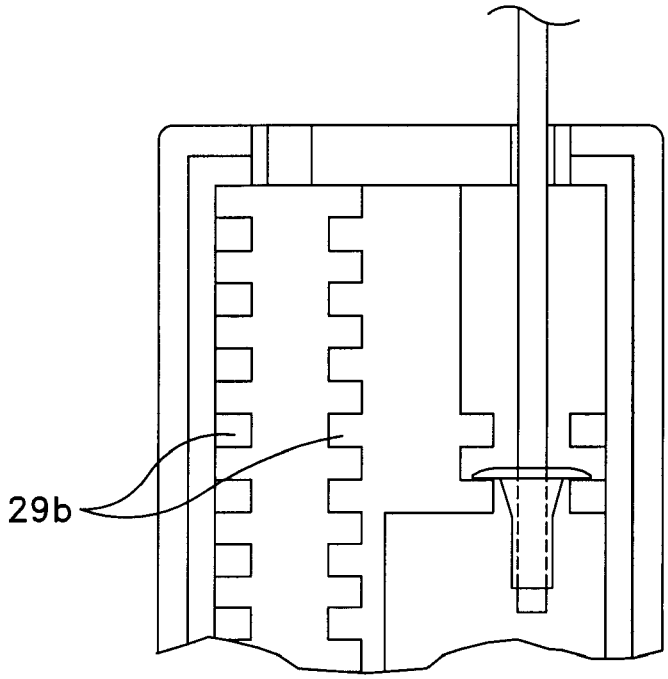
FIG. 5 is a front view of the anti-theft tag of FIG. 4.
Figure 6:
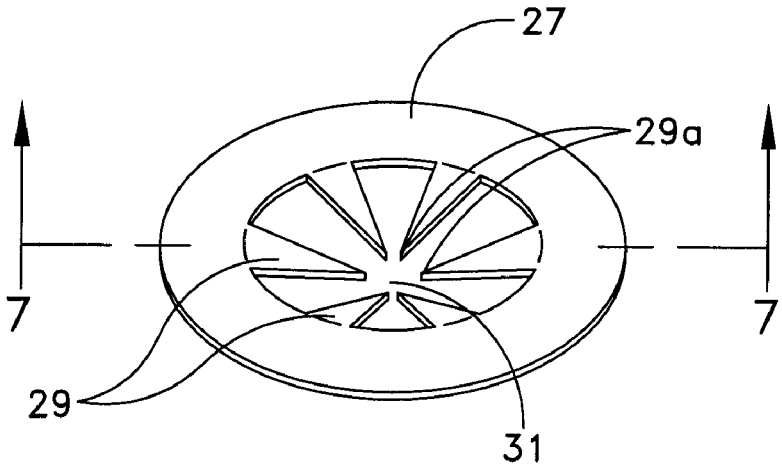
FIG. 6 is a perspective view of an exemplary single crimping member.
Figure 7:
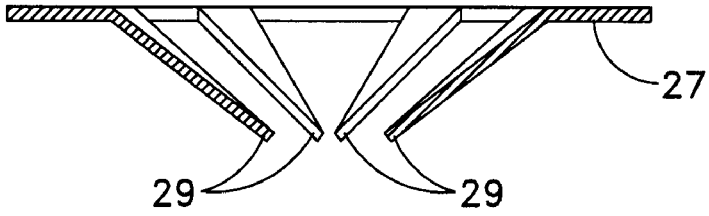
FIG. 7 is a cross-sectional view of the crimping member of FIG. 6 taken along line 7-7.
Figure 8:
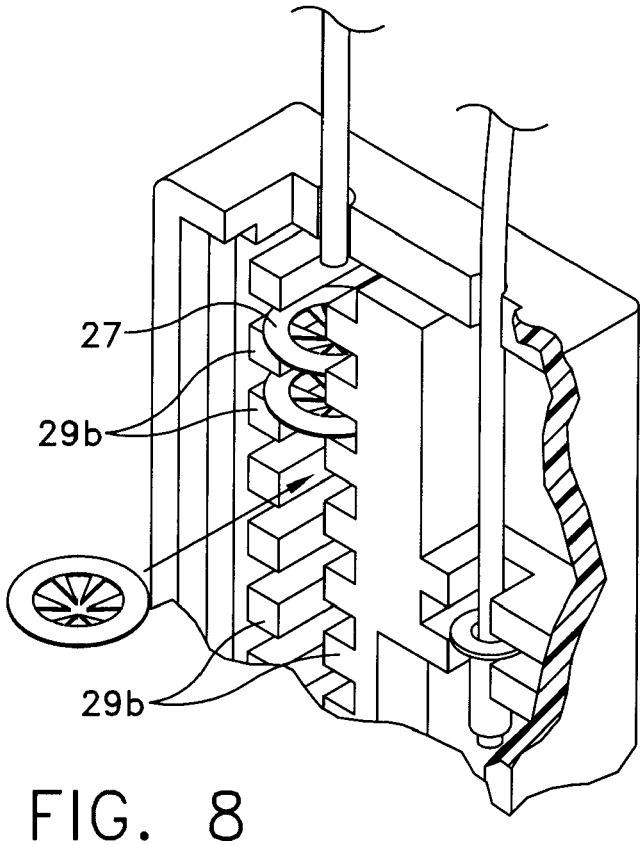
FIG. 8 is an enlarged perspective view of the top section of the housing body of FIG. 3 showing insertion of the crimping members of FIG. 6.

A first embodiment of an anti-theft security tag 10 including an electronic article surveillance marker 12 for attachment to an article, such as a watch band 13, bottle 15, or other article is illustrated in FIGS. 1-23. As used herein, the term "article" refers to any type or style of consumer product. Also as used herein, the term "crimp" or "crimped" is used in a conventional manner to mean pressing, squeezing, pinching, biting or the like into the member to be secured. Finally, as used herein, "watch" refers to any style or type of watch which may be worn by a user. However, it is expressly understood that the present invention is not limited to use with watches, or bottles, and may be used with any of a variety of articles as would be known to those of skill in the art.

The tag 10 of the present embodiment includes an engagement member 14 for securing the tag to the article, and a housing 16. Disposed within the housing is an internal crimping member 26 which, in the present embodiment is a self-crimping member as described in greater detail below. The housing also supports an electronic article surveillance (EAS) marker 12. In the present embodiment, the housing 16 preferably includes a base 18*a* and a cover 18*b*. The base may have a front wall 19*a*, side walls 19*b* and 19*c*, a bottom wall 19*d* and a top wall 19*e*, the walls bounding an interior cavity 20 of the base. The top wall 19*e* may include a pair of indents 42 which, when the base 18*a* is engaged with the cover 18*b* mate with corresponding indents 44 to form a pair of openings 30*a*, 30*b* sized to receive a first end 22*a* and a free second end 22*b*, respectively, of the engagement member 14. The openings 30*a*, 30*b* preferably provide access to a pair of channels 21*a*, 21*b* disposed within the housing. The cover 18*b* is sized to fit over the base 18*a* and is secured there to during use. In the present embodiment, the cover 18*b* includes tabs 15 which are sized to fit within corresponding openings formed in the base. The base 18*a* and the cover 18*b* also preferably form an exit opening 23 when secured together in the present embodiment. EAS marker 12 may be supported within the housing, for example, on an inner surface of the cover 18*b*, such that it is hidden within housing 16 once assembled. Alternatively, other types of housings may be utilized, as would be known to those of skill in the art.

Figure 18:
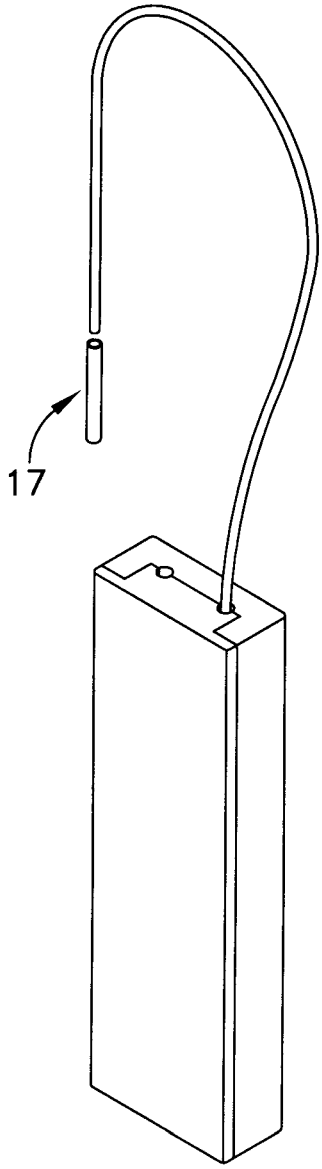
FIG. 18 is a perspective view of the housing of FIG. 1 showing an end cap supported on the insertion end of the line.
Figure 19:
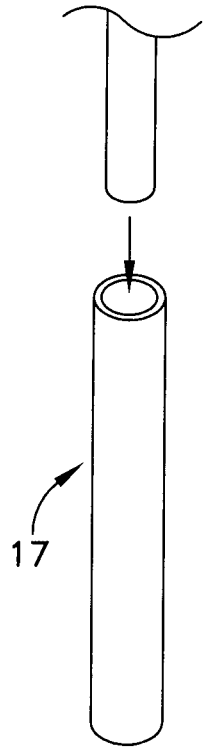
FIG. 19 is a perspective view of the end cap of FIG. 18 showing insertion of the second end of the line.
Figure 20:
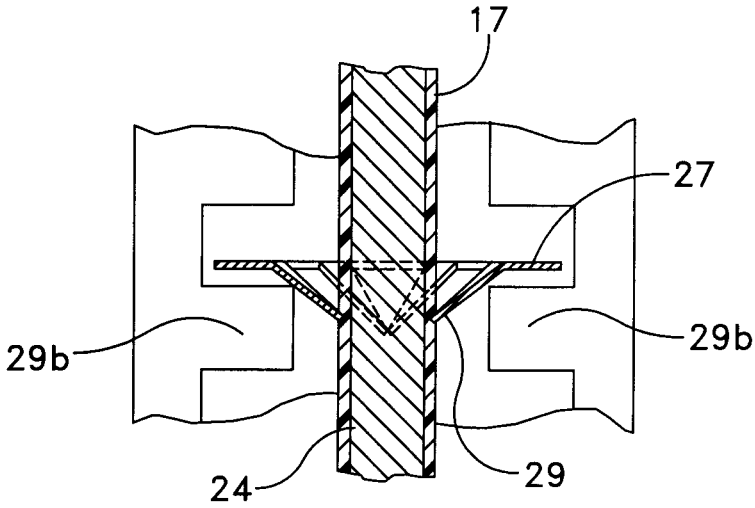
FIG. 20 is a partial cross sectional view of the end cap, line and crimping member, showing the crimping member crimping the end cap.

The engagement member 14 may take any of a variety of forms, suitable for engagement with an article, and preferably includes a line 24, and one or more crimping members 26*a-d* for retaining the free or second end 22*b* of the line within the housing during use, as described in greater detail below. The line may preferably be made of wire (coated or non-coated), nylon or other semi-rigid monofilament lines, or other plastic member which is sufficiently strong so as to withstand tampering. In the present embodiment, the line is able to withstand about 40 to about 50 lbs of pressure before beginning to fail, although lines being able to withstand any of a variety of pressures may be utilized, as desired for the particular application. In the present embodiment, the line has a generally continuous outer surface which is crimped when inserted into the crimping members 26*a*-26*d*. Alternatively, a reinforcing member or end cap 17 may be secured to all or part of the line, as shown in FIGS. 18-20, and described in greater detail below.

In the present embodiment, the crimping member is internally disposed within the housing and is preferably self-crimping such that it automatically engages and crimps the line upon insertion of the line within the crimping member, without additional manual crimping. In this manner, the line is prevented from being withdrawn as soon as it engages the crimping member. The crimping member may take any of a variety of forms, provided that it engages the line so as to crimp it to deter removal of the line from engagement with the crimping member. In the present embodiment, a plurality of washer or disc shaped crimping members 26*a*-26*d* are illustrated. Each crimping member preferably includes an annular ring 27 and a plurality of inwardly extending teeth or fingers 29 (FIGS. 6-7) which crimp the line upon engagement and which may preferably flex during insertion of the line as described in greater detail below. The discs preferably operate to automatically crimp the second end of the line 22*b* when it is inserted within each of the discs. In this manner, a separate crimping step is avoided.

Figure 9:
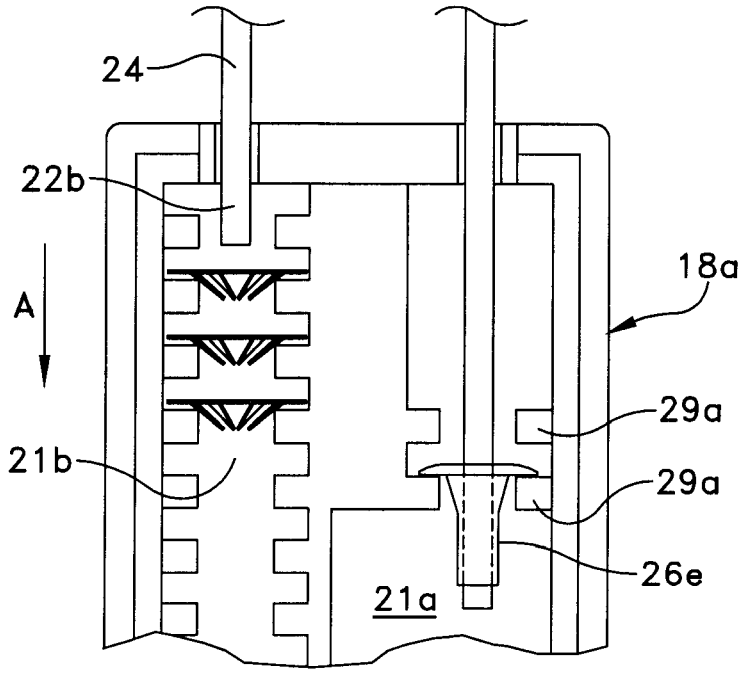
FIG. 9 is a front view of FIG. 8 showing insertion of the free end of a line into the crimping channel.

In the present embodiment, the teeth or fingers 29 may each have a generally triangular shape with pointed end 29*a* to engage and crimp the line, although other shapes may be utilized as would be known to those of skill in the art. The crimping members 26*a*-26*d* are each preferably supported within the channel 21*b* so that they are stationary longitudinally within the channel. For example, the crimping members may be supported within the channel by a plurality of shelves, or ledges 29*b*, as best shown in FIG. 9, such that they are free to rotate within the shelves or ledges, but remain positioned at a predetermined longitudinal distance within the channel. The crimping members are preferably supported in alignment with each other, but may be selectively positioned along the length of the channel, as desired. For example, although the crimping members are illustrated as being supported on successive ledges, empty ledges may be disposed between the crimping members. Also, the crimping members can be supported anywhere along the length of the channel, at the top, bottom or mid section, or a combination there of. Alternatively, the crimping members may be otherwise supported within the channel, as would be known to those of skill in the art.

Figure 10:
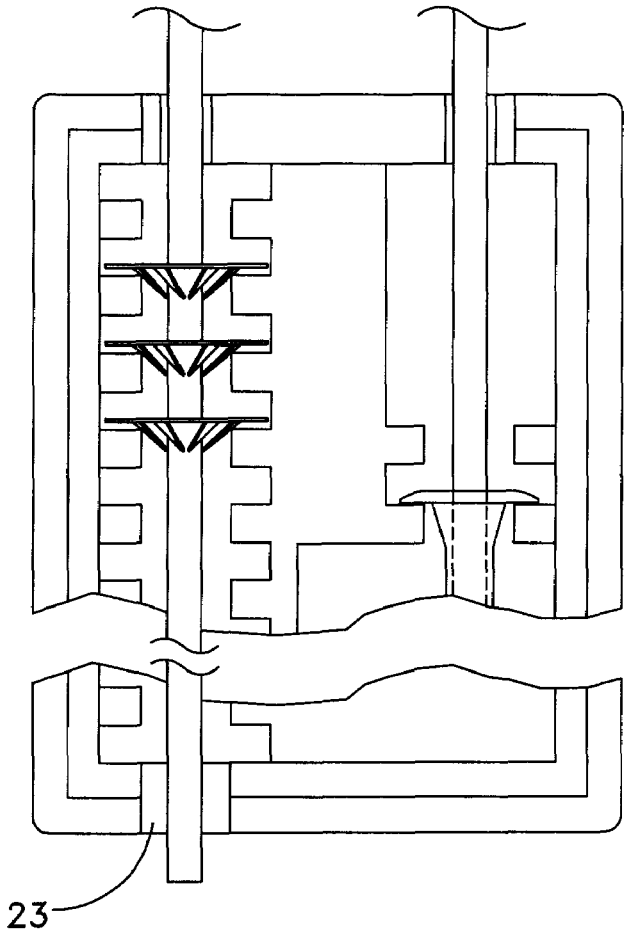
FIG. 10 is a front view of FIG. 8 showing insertion of the free end of the line into the crimping members.
Figure 11:
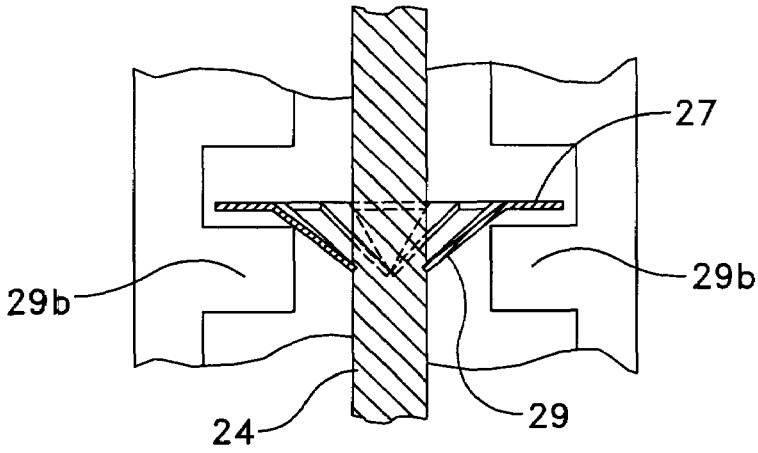
FIG. 11 is an enlarged view of FIG. 10 showing insertion of the line into a single crimping member.

In addition to being aligned with each other, the center 31 of the crimping members are aligned with the opening 30*b* into the channel 21*b*. In this manner, upon insertion of the free, insertion or second end 22*b* into the center 31 of the crimping member in the direction of arrow "A" (FIG. 9) the flexible fingers 29 engage and crimp the line 24 (FIG. 10). By crimping the line the fingers prevent the line from being moved in a direction opposite arrow "A". The first end 22*a* is also secured within the housing, for example within channel 21*a*. In the present embodiment, a sleeve 26*e* is supported on ledge 29*a* and is used to secure the first end 22*a* within channel 21*a*. It is preferred that the first end be secured within the housing so that it may not be tampered with by a consumer. Alternatively, the first end may be otherwise supported on or within the housing, as would be known to those of skill in the art. Although four, disc shaped crimping members are shown, any number and shape crimping members may be utilized, as desired.

Figure 12:
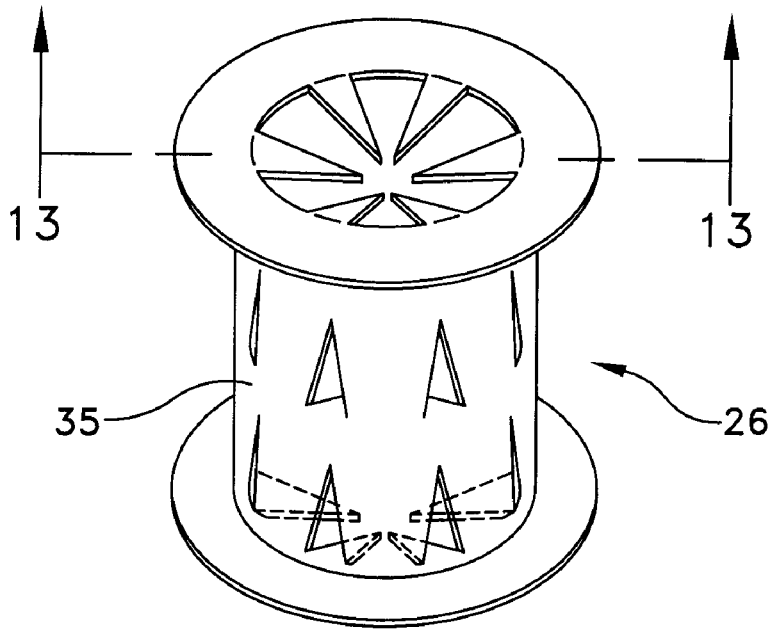
FIG. 12 is a perspective view of an alternate crimping member.
Figure 13:
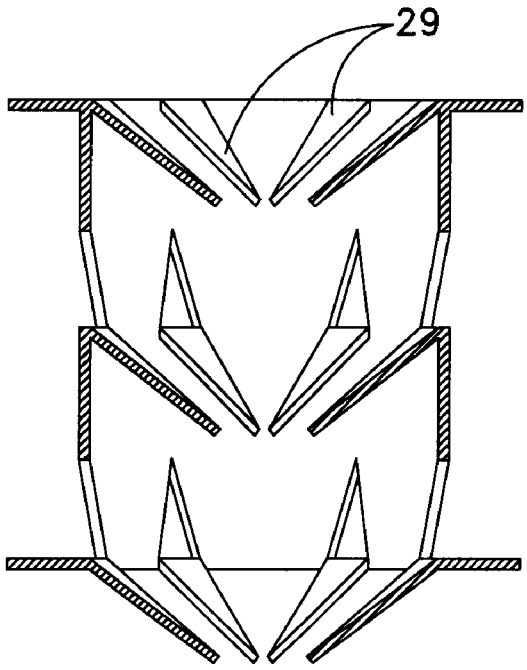
FIG. 13 is a cross-sectional view of the crimping member of FIG. 12 taken along line 13-13.
Figure 14:
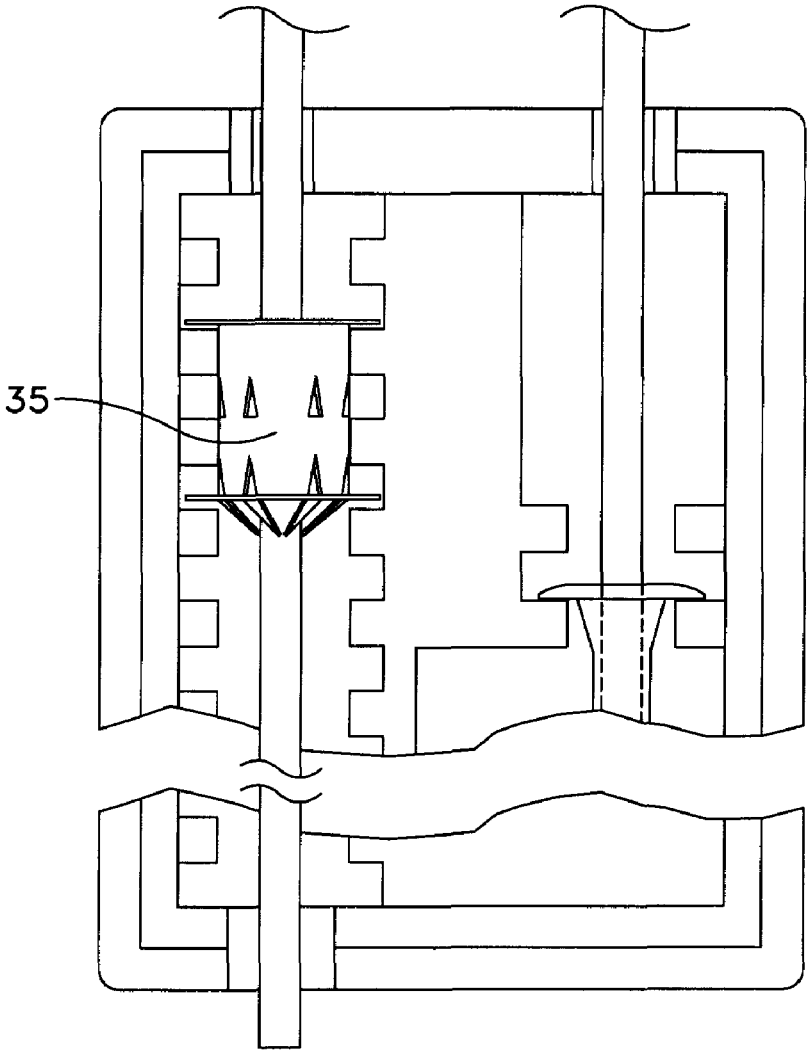
FIG. 14 is a front view with cover removed of the housing of FIG. 1, showing insertion of the free end of the line into the crimping member of FIG. 12.
Figure 15:
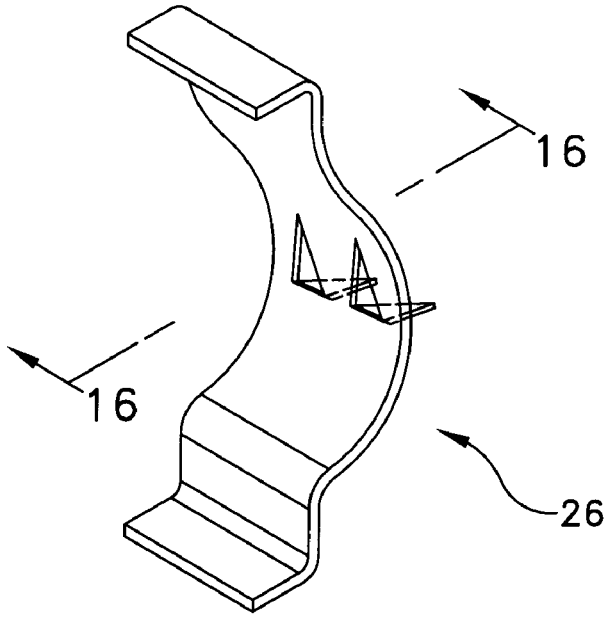
FIG. 15 is a perspective view of another alternate crimping member.
Figure 16:
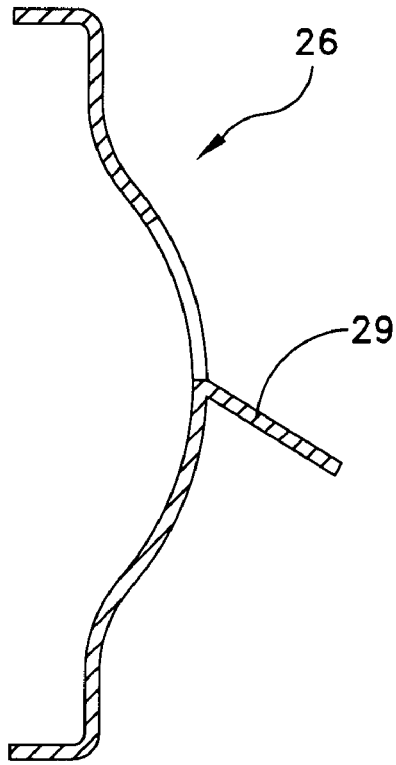
FIG. 16 is a cross-sectional view of the crimping member of FIG. 15 taken along line 16-16.
Figure 17:
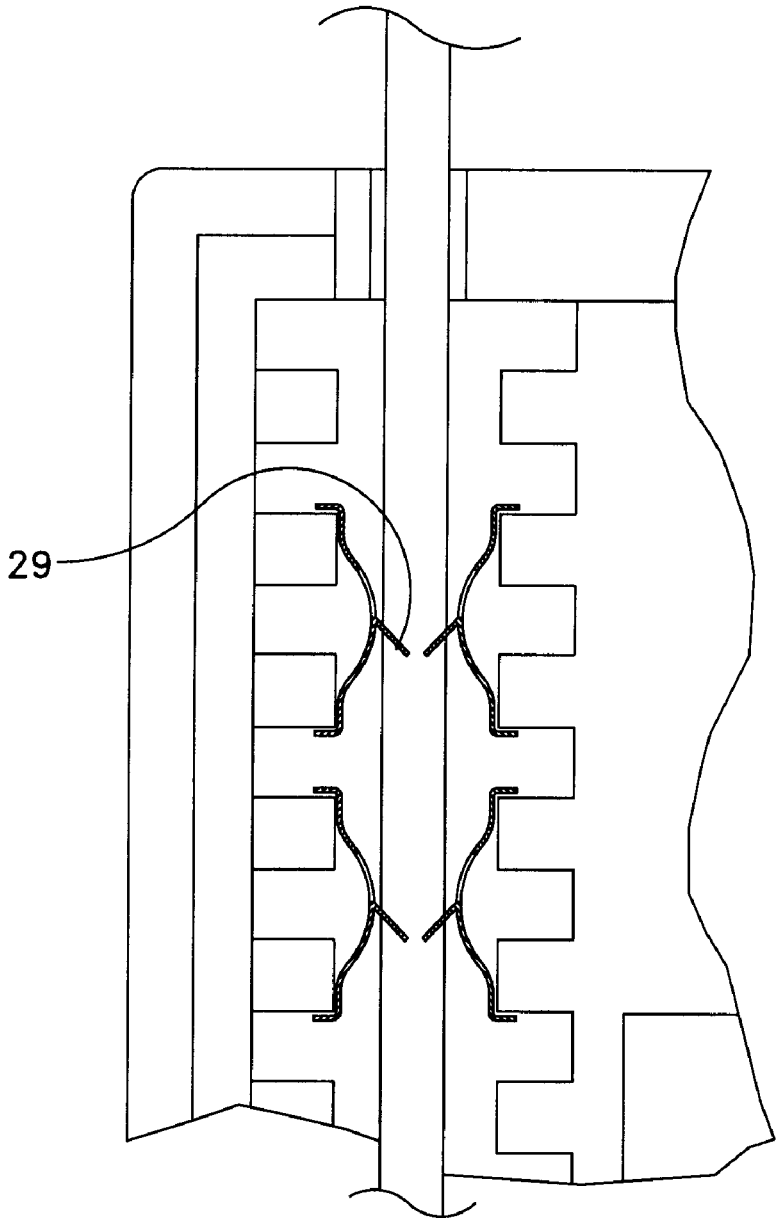
FIG. 17 is a front view with cover removed of the housing of FIG. 1, showing insertion of the free end of the engagement member into the crimping member of FIG. 15.

Referring not to FIGS. 12-17 exemplary alternate embodiments of the internally disposed crimping members are illustrated. FIGS. 12-14 illustrate a cylindrical or tubular crimping member 26, having a plurality of inwardly extending teeth or fingers 29, which operate in the same manner as discussed above with respect to the discs. The fingers 29 may be supported on annular ring 27, or within the body 35 of the tubular member, or both. FIGS. 15-17 illustrate leaf spring shaped crimping members 26. In this embodiment, instead of a round crimping member having an aperture bounded by an annular ring, a pair of springs each including at least one crimping tooth or finger 29, are spaced opposite each within the body of the housing. In this manner, as the line is inserted within the space or channel, the crimping teeth 29 again crimp the line in the manner discussed above with respect to the crimping discs and cylinder. Although shown as being supported by ledges 29*b*, alternate methods of supporting the crimping members may be utilized, as would be known to those of skill in the art. As shown in FIGS. 18-20 a reinforcing member or end cap 17 may be secured to all or part of the line, regardless of the type of crimping member utilized. In such a case, the end cap is considered to be part of the line, even if it is not a unitary member. As such, when the end cap is inserted within the line and crimped (FIG. 20), because it is secured to the line, the line likewise be prevented from removal from the crimping member. As will be appreciated, other types of crimping members may be utilized, provided that they crimp the line in order to prevent the line from being removed from the housing.

Figure 21:
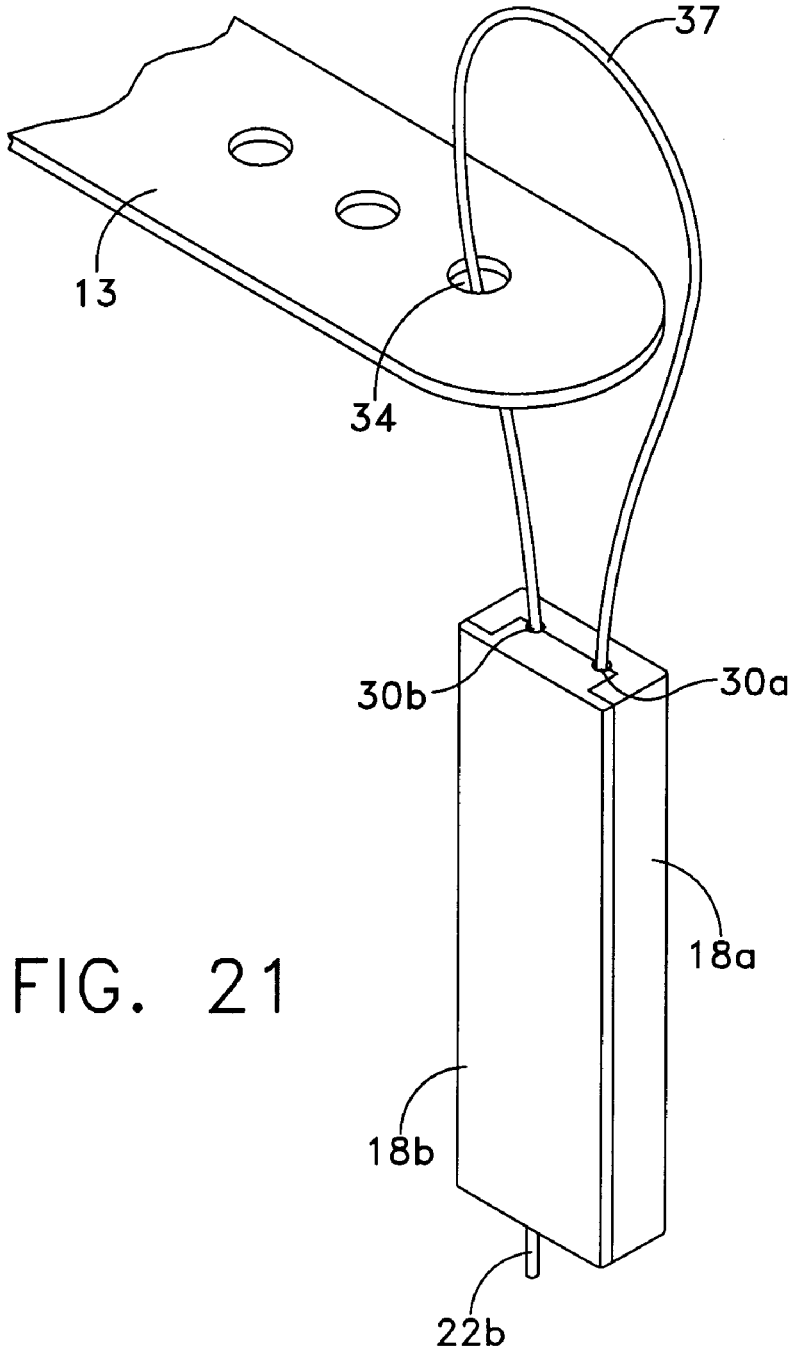
FIG. 21 is a perspective view showing attachment of the anti-theft tag of FIG. 1 to a watch band.
Figure 22:
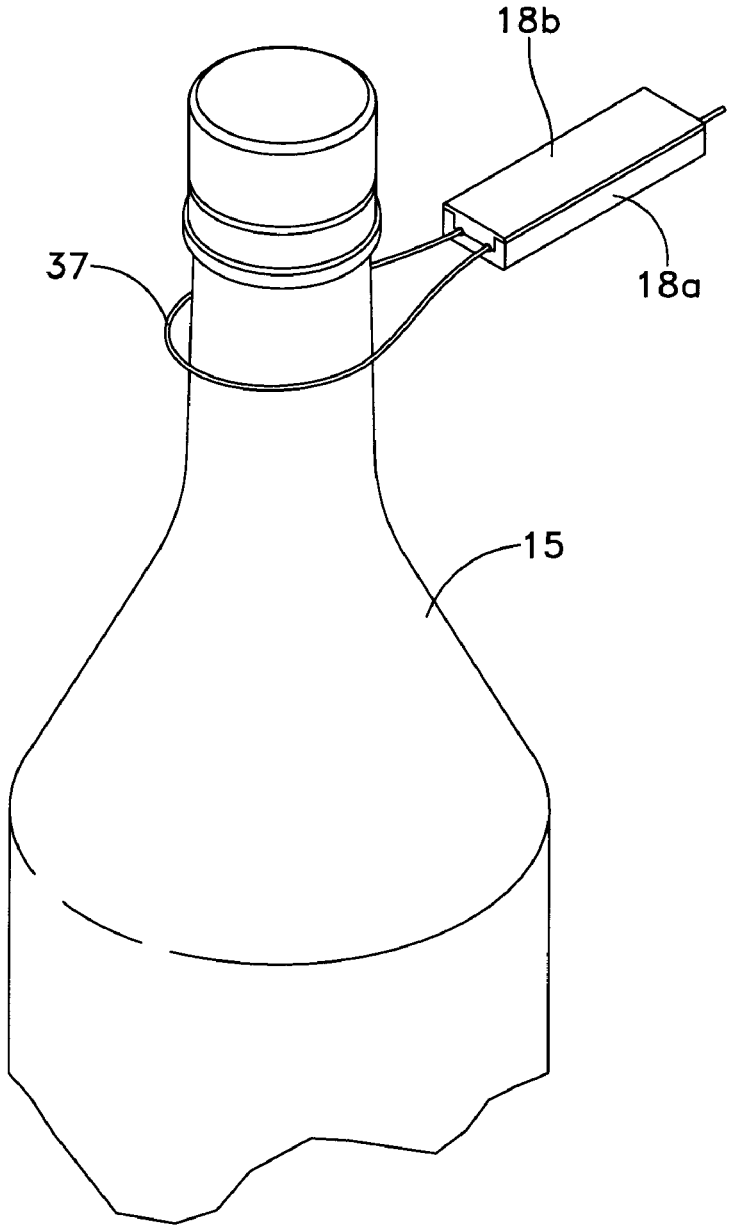
FIG. 22 is a perspective view showing attachment of the anti-theft tag of FIG. 1 to a bottle neck.
Figure 23:
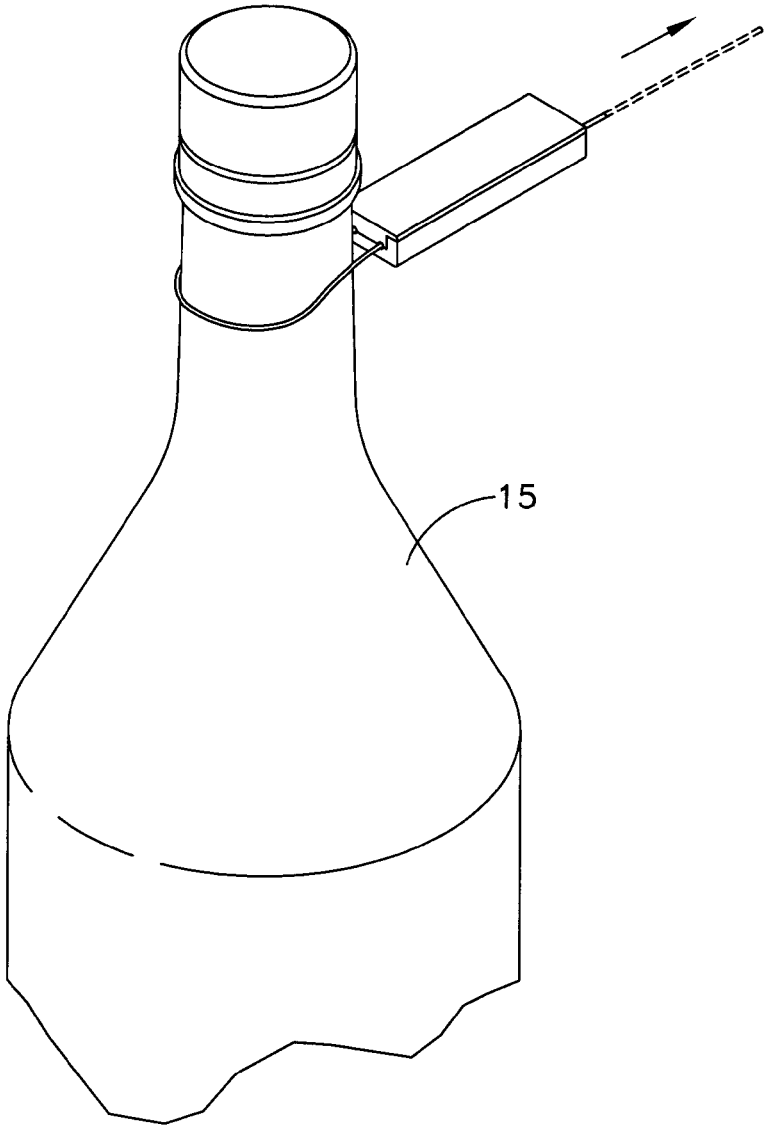
FIG. 23 is a perspective view showing tightening of the anti-theft tag of FIG. 22 to the bottle neck.
Figure 24:
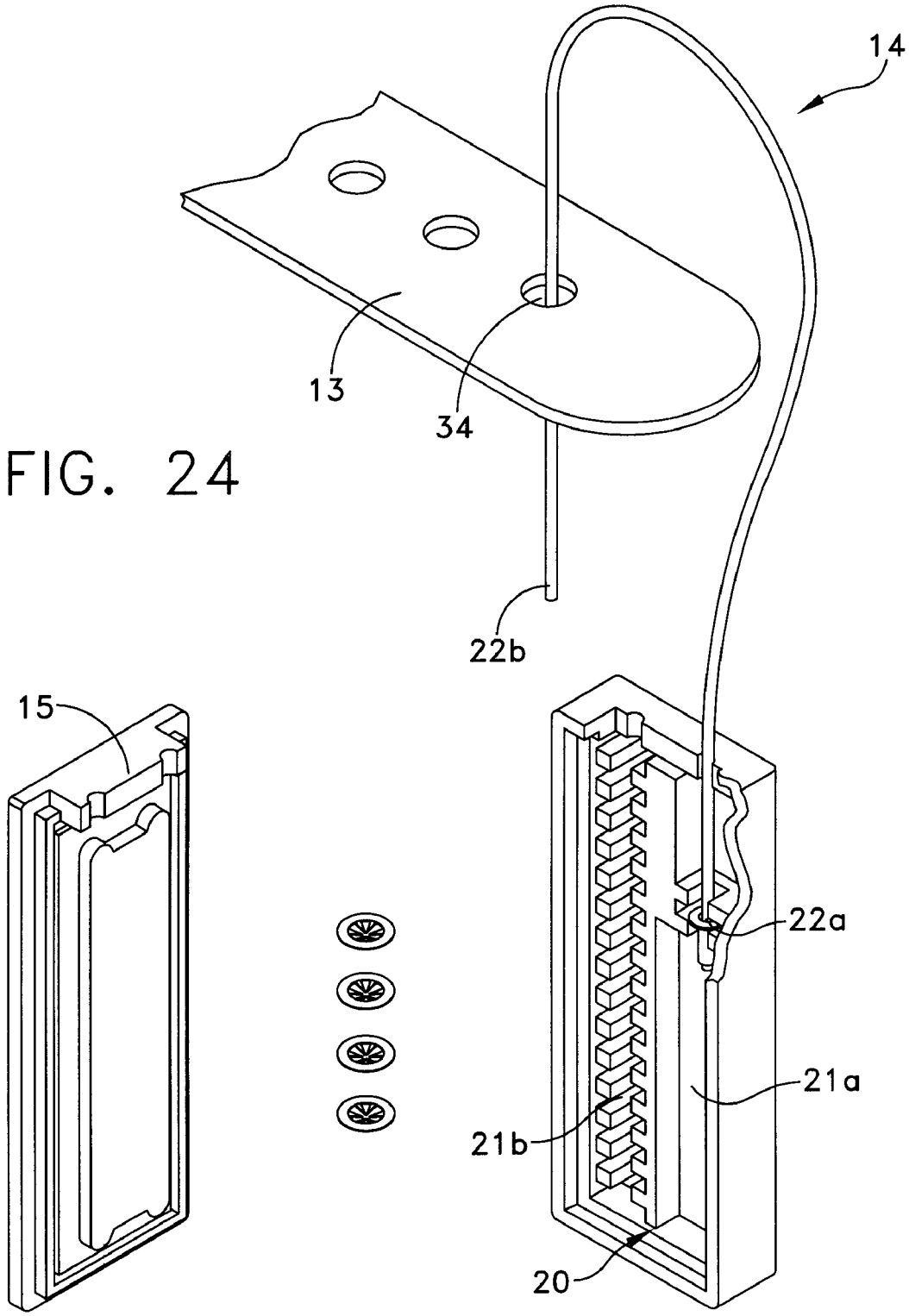
FIG. 24 is a perspective view of an anti-theft tag in accordance with a second embodiment with the housing cover separated from the housing body.
Figure 25:
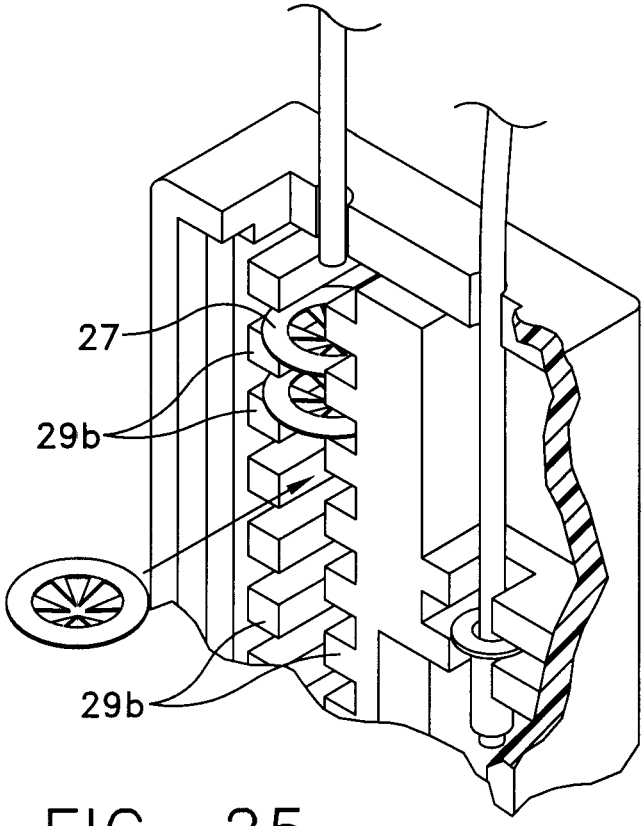
FIG. 25 is an enlarged perspective view of the top section of the housing body of FIG. 15 showing insertion of exemplary crimping members.
Figure 26:
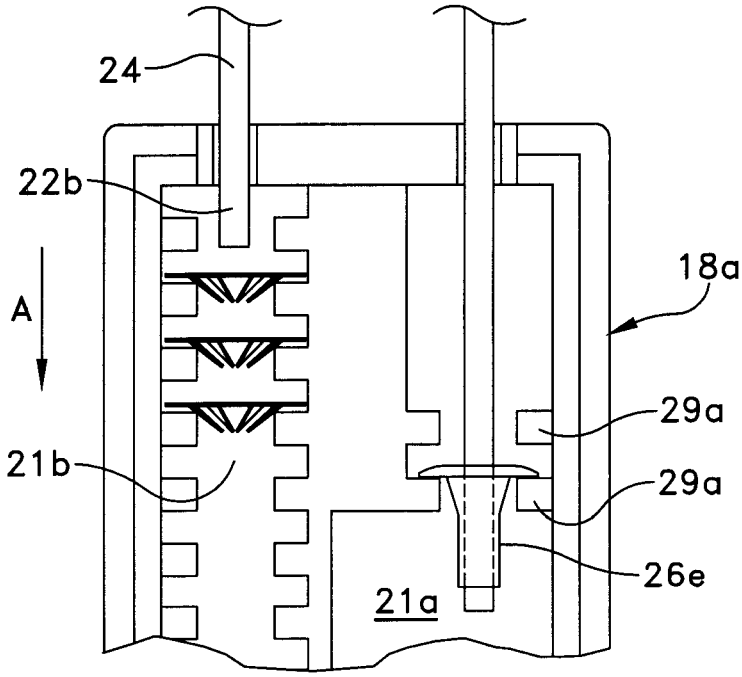
FIG. 26 is a front view of FIG. 25 showing insertion of the free end of the line into the crimping channel.
Figure 27:
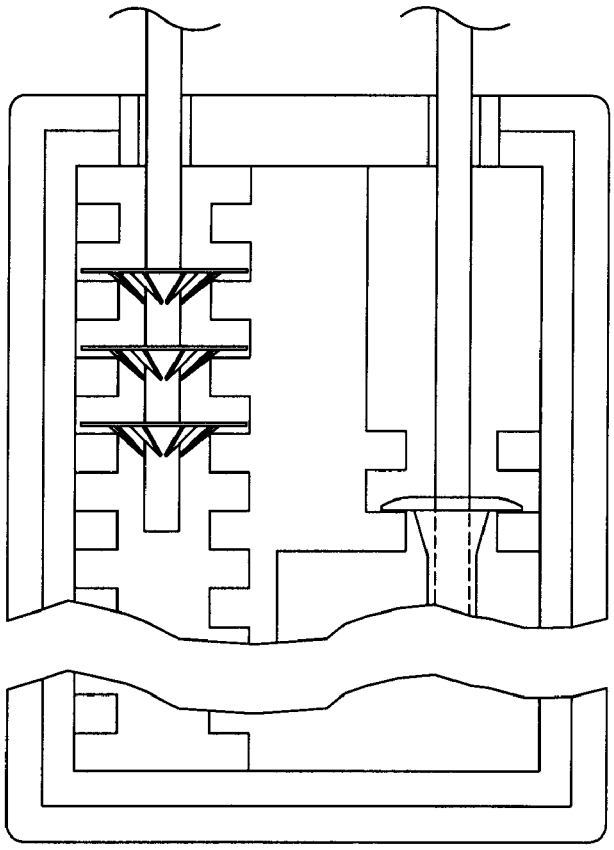
FIG. 27 is a front view of FIG. 25 showing insertion of the free end of the line into the exemplary crimping members.
Figure 28:
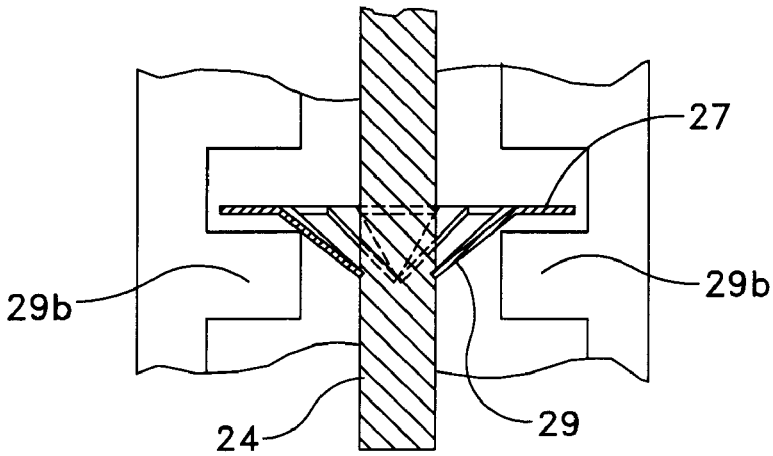
FIG. 28 is an enlarged view of FIG. 27 showing insertion of the line into a single crimping member.
Figure 29:
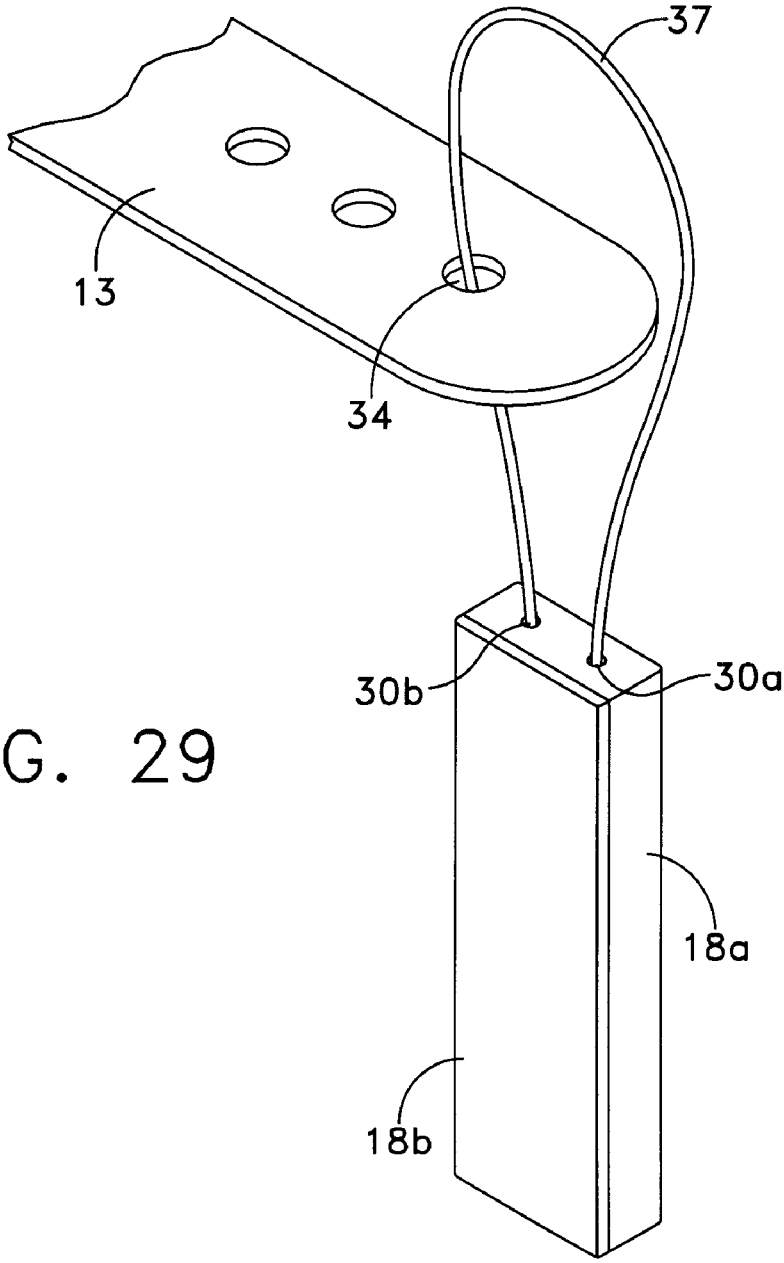
FIG. 29 is a perspective view showing attachment of the anti-theft tag of FIG. 24 to a watch band.

In use, to attach the anti-theft security tag, the insertion, or second end 22*b* is inserted about the article, for example a hole 34 in a watch band or around the neck of a bottle, and into opening 30*b* so as to form a loop 37 (FIGS. 21-23). The second end 22*b* is then inserted into channel 21*b* and through center 31 in the at least one crimping member 26*a-d* disposed within channel 21*b* (FIG. 10). Once disposed through the center 31 flexible fingers angle in a downward direction, i.e. toward exit opening 23, and engage the line 24. In the present embodiment, the pointed ends of the fingers engage the line such that the second end 22*b* of the line cannot be moved in the upward direction, toward opening 30*b*, but can only be moved in the opposite, downward direction. The second end 22*b* can pass entirely through the housing and out of opening 23. In this manner, the size of loop 37 is adjustable by increasing the length of the line which exits the housing through opening 23. The line continues to be fed through the opening 40 until loop 37 reaches the desired size. Although the loop 37 can be made continually smaller, it cannot be made larger because the crimping members allow movement of the second end 22*b* in only the downward direction. Once the loop reaches the desired size, the tail end 22*b* may be cut so that it is flush with respect to the bottom 19*d* of the base.

Referring now to FIGS. 24-29, an alternate embodiment of the anti-theft tag 10 is illustrated. This embodiment is identical to the embodiment of FIGS. 1-23, except that the size of the loop is limited by the length of the line 24 that fits within the housing. In particular, exit opening 23 is eliminated such that the second end 22*b* is captured within the housing and does not exit the housing. In this manner, the second end 22*b* is tamper resistant as the consumer can not reach into the housing. The alternate embodiment may be used, for example, when the product to which the anti-theft tag is to be attached is know such that the length of the line 24 can be pre-cut to size during manufacturing. The elimination of opening 23 limits the amount the loop 37 can be adjusted to the length of the housing. Other than the line and hence loop 37 being limited in adjustment, the embodiment of FIGS. 24-29 functions in the same manner as that of FIGS. 1-23. Namely, the loop cannot be made larger once the second end is inserted within the crimping members, because the crimping members allow movement of the second end 22*b* in only the downward direction (i.e., into the housing).

Figure 30:
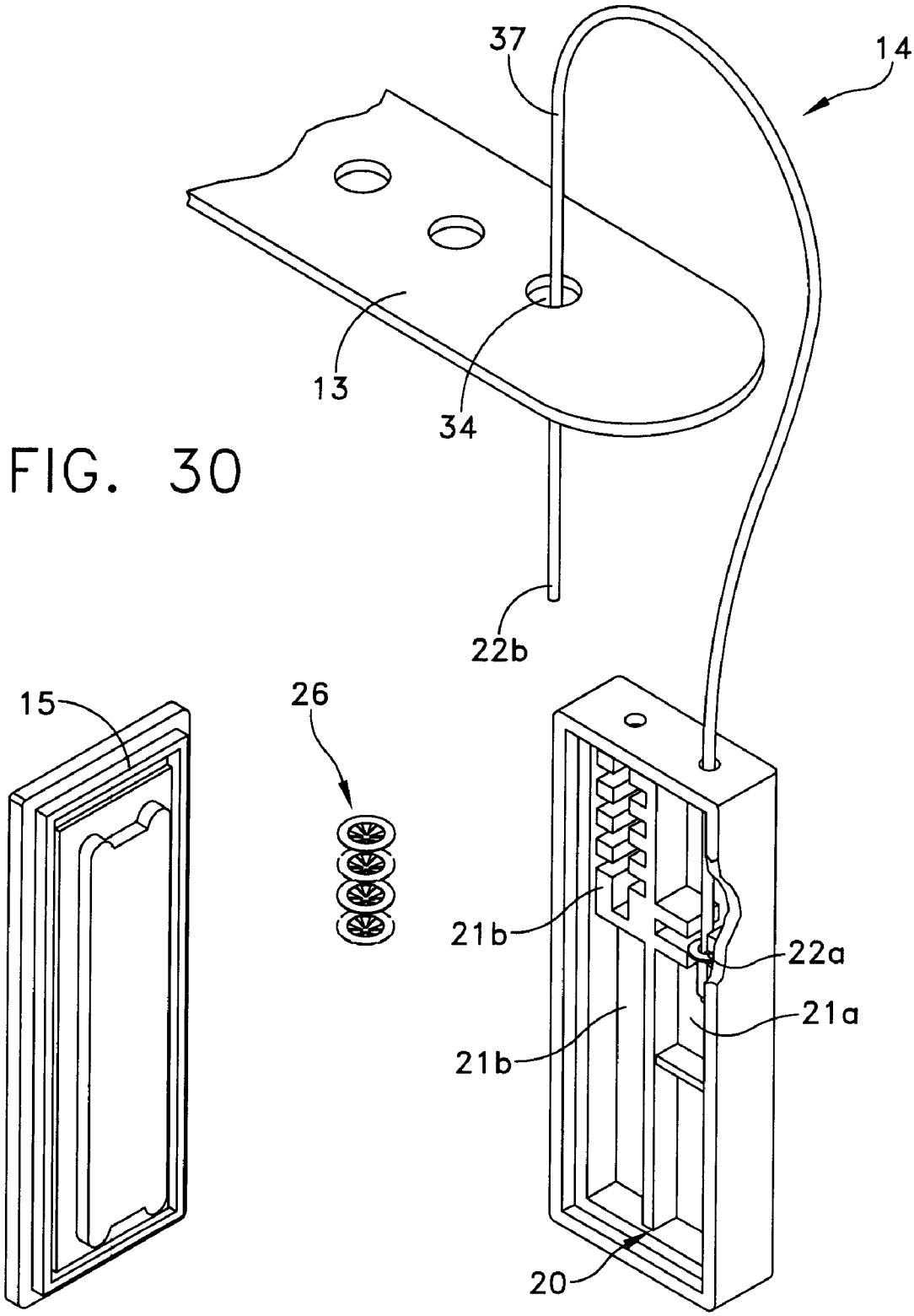
FIG. 30 an exploded view of an anti-theft tag in accordance with a third embodiment.
Figure 31:
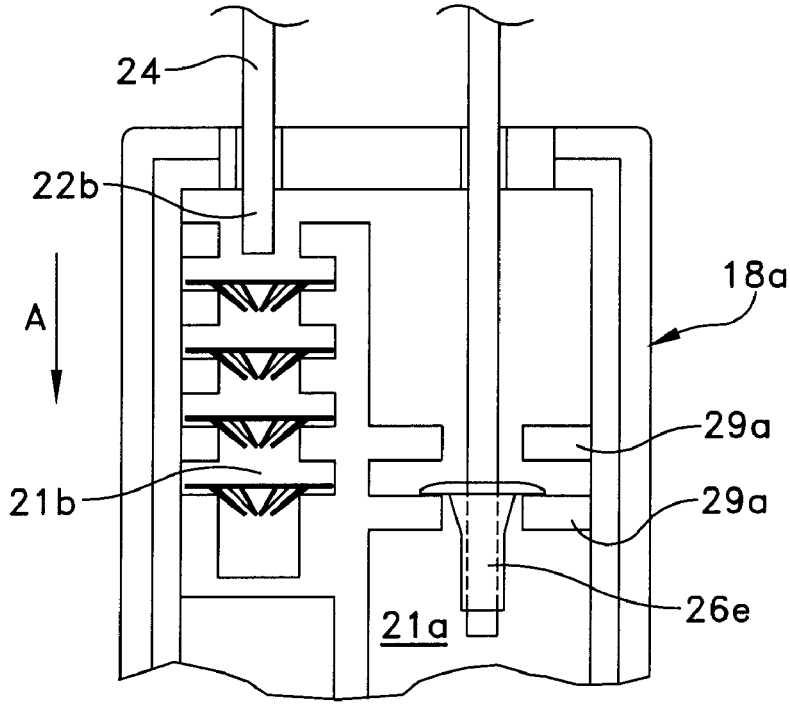
FIG. 31 is a front view of the anti-theft tag of FIG. 30 with cover removed, showing insertion of the free end of the line into the crimping channel.
Figure 32:
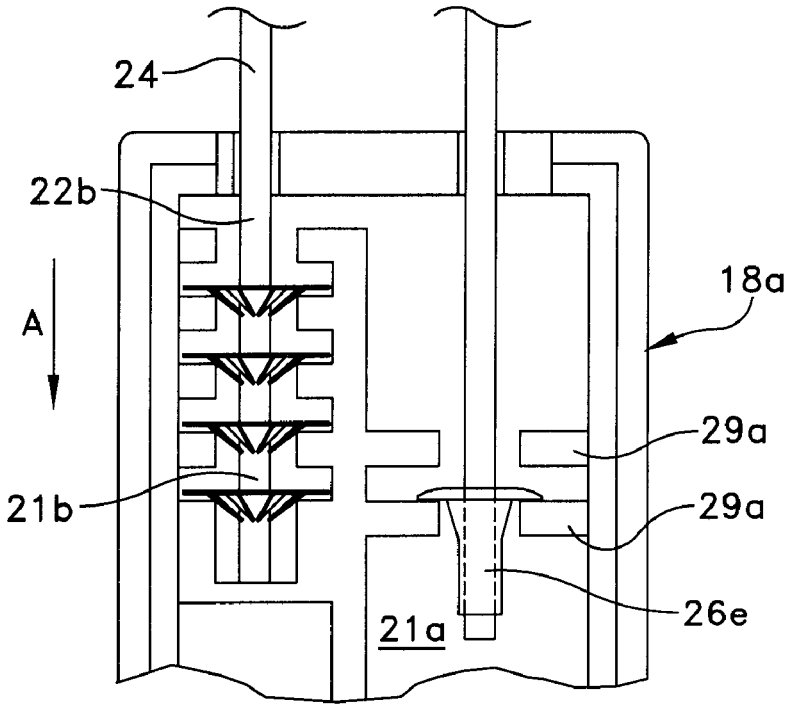
FIG. 32 is a front view of the anti-theft tag of FIG. 30 with cover removed, showing insertion of the free end of the line into the exemplary crimping members.

A third alternate embodiment of the anti-theft tag 10 is illustrated in FIGS. 30-32. This embodiment is identical to the embodiment of FIGS. 24-29, except an interior wall 25 is disposed within channel 21*b* adjacent a lowermost ledge 29*b*. The interior wall 25 acts as a stop to prevent further advancement of the second end 22*b* of the line 24 within channel 21*b*. In this embodiment, the loop 37 which is formed exterior to the housing has a generally fixed size and is not adjustable in an appreciable manner. The size of the loop 37 is determined by the length of line utilized to form the loop and the depth at which the wall 25 is placed within the channel. In the present embodiment, any number of lines of varying lengths may be provided for use with the housing 16, depending upon the particular application. In this manner, the size of the loop is adjustable (by choosing a certain length of line) even if the second end 22*b* of the line is prevented from advancing within the channel 21*b* to effectuate adjustment of the loop 37.

Figure 35:
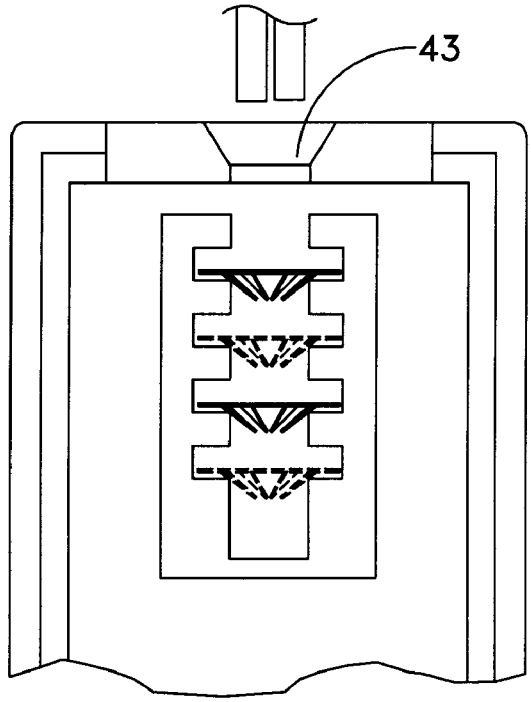
FIG. 35 is a front view of the anti-theft tag of FIG. 33 with cover removed, prior to insertion of the free ends into the crimping channel.
Figure 36:
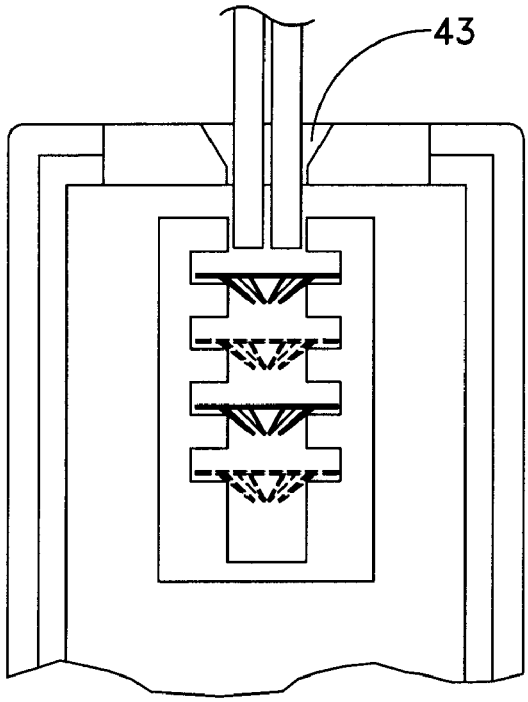
FIG. 36 is a front view of the anti-theft tag of FIG. 33 with cover removed, showing insertion of the free ends into the crimping channel.
Figure 37:
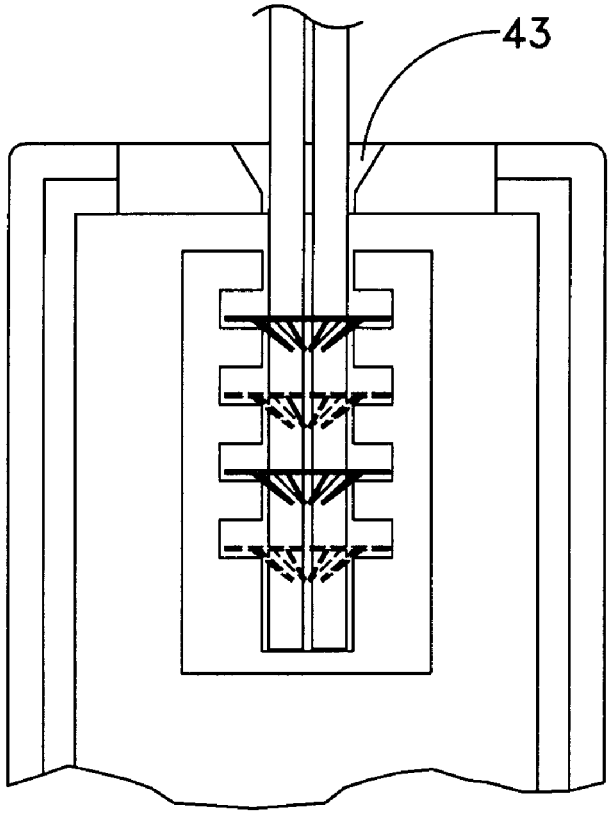
FIG. 37 is a front view of the anti-theft tag of FIG. 33 with cover removed, showing insertion of the free ends into the crimping member.
Figure 38:
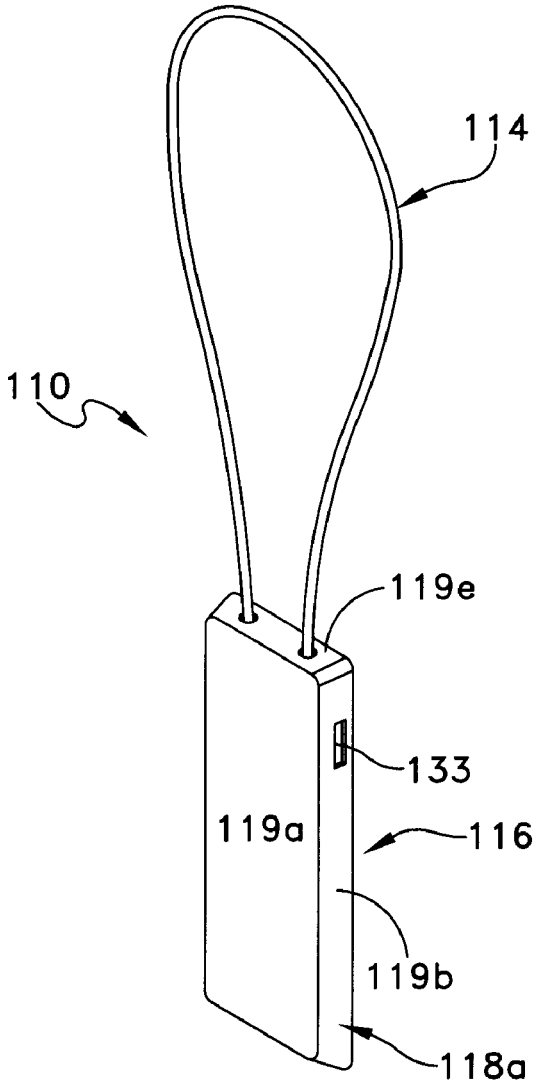
FIG. 38 is a front perspective view of an anti-theft tag in accordance with a fifth embodiment.
Figure 39:
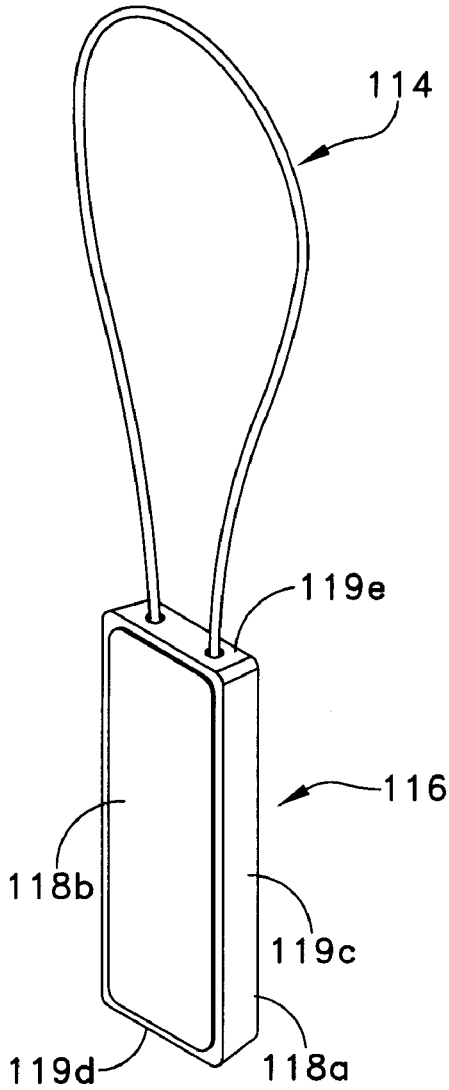
FIG. 39 is a rear perspective view of the anti-theft tag of FIG. 38.
Figure 40:
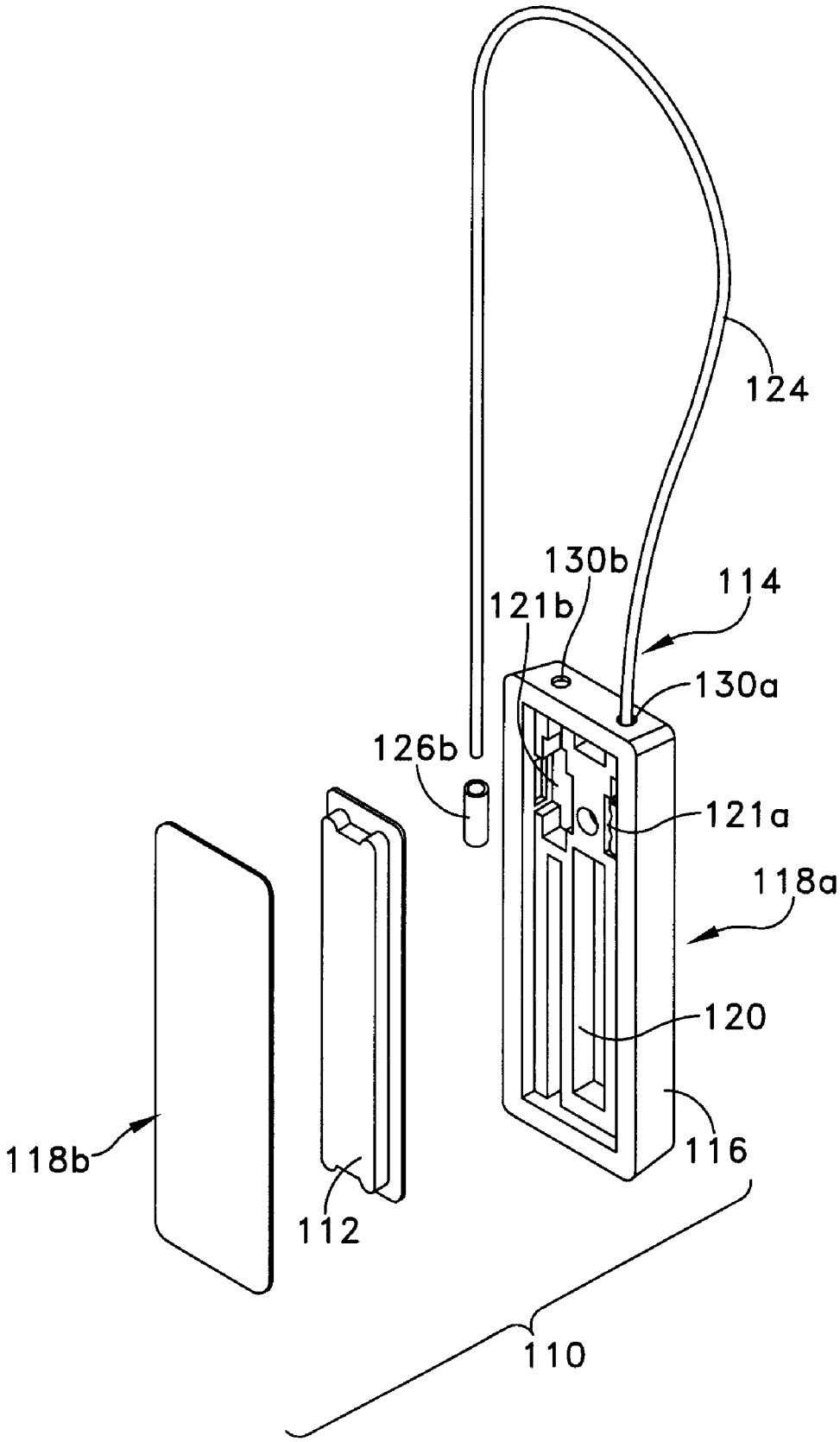
FIG. 40 is an exploded view of the anti-theft tag of FIG. 38.
Figure 41:
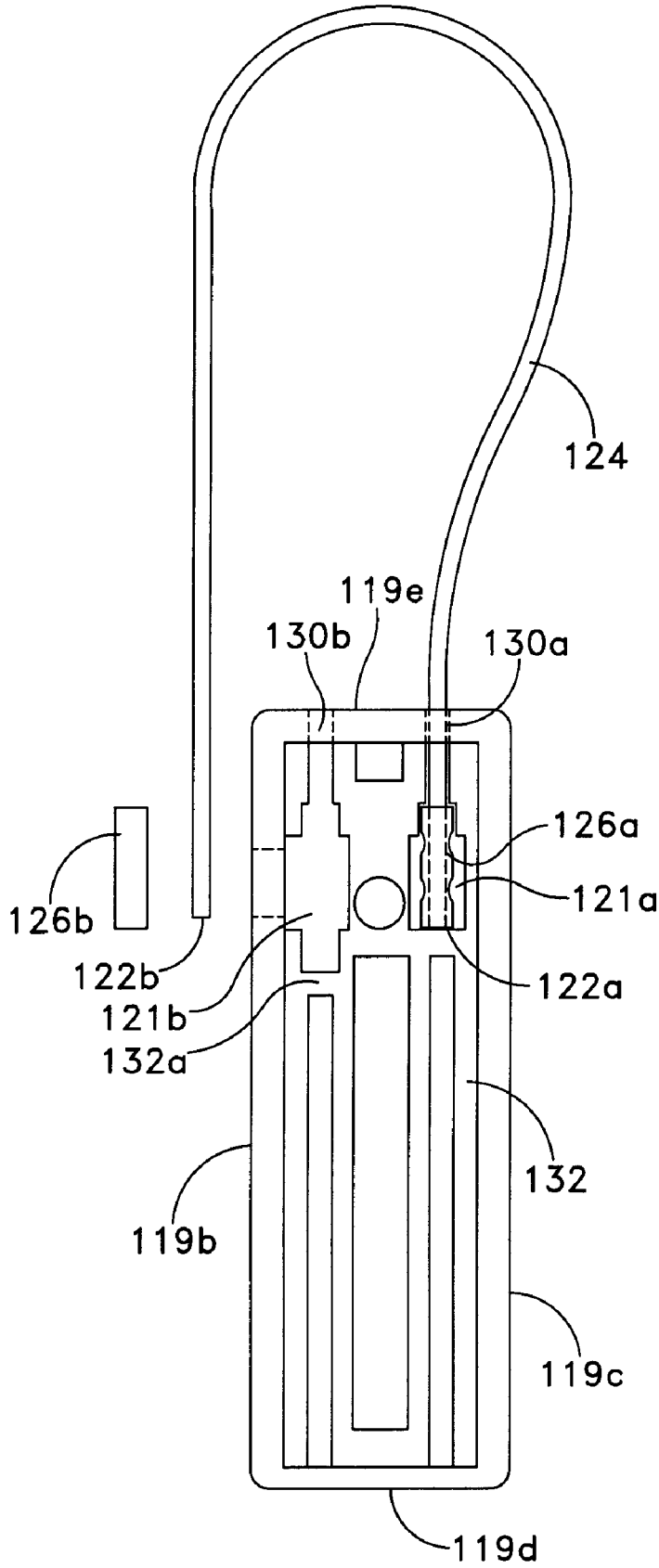
FIG. 41 is a top plan view of the anti-theft tag of FIG. 38 with the backing removed.
Figure 42:
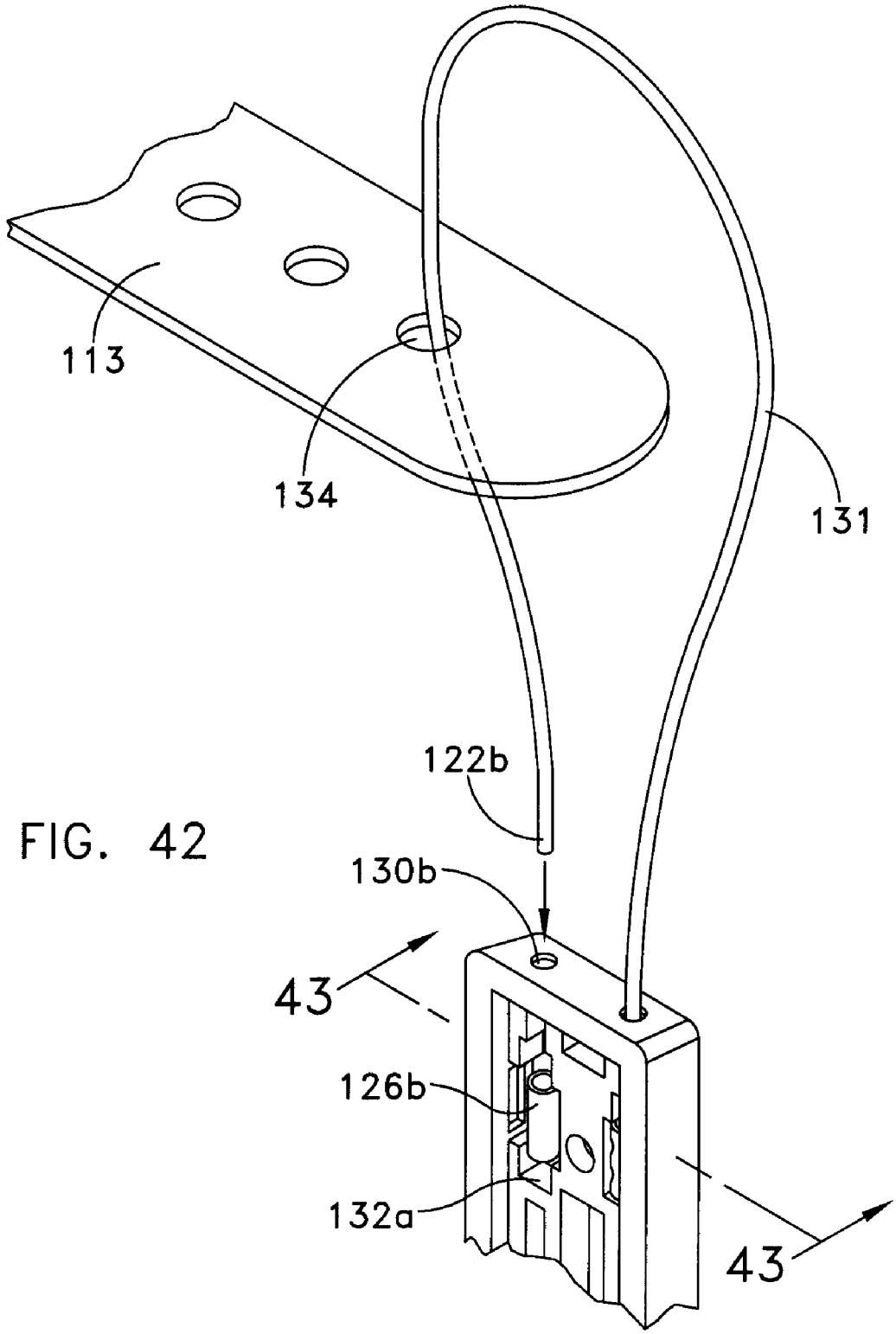
FIG. 42 is a perspective view of a top portion of the anti-theft tag of FIG. 41 during attachment.
Figure 43:
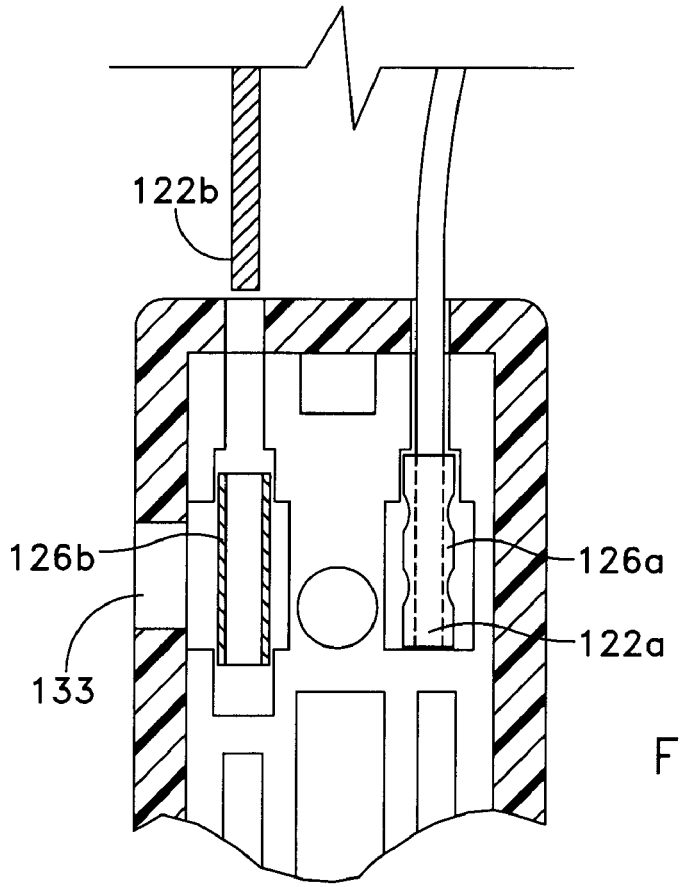
FIG. 43 is a cross sectional view taken along lines 43-43 of FIG. 42 prior to insertion of a second end of the line into the housing.
Figure 44:
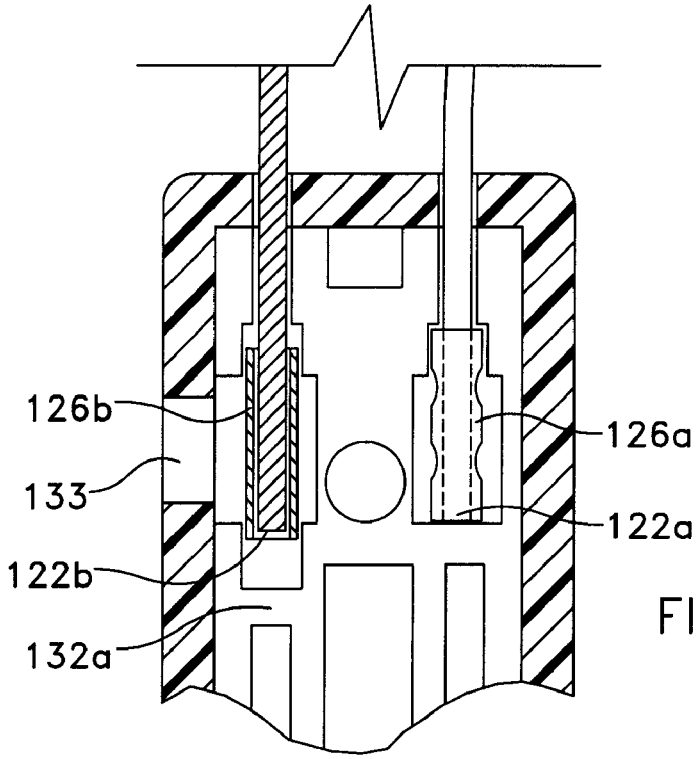
FIG. 44 is a is a cross sectional view taken along lines 43-43 of FIG. 42 after insertion of a second end of the line into the housing.
Figure 45:
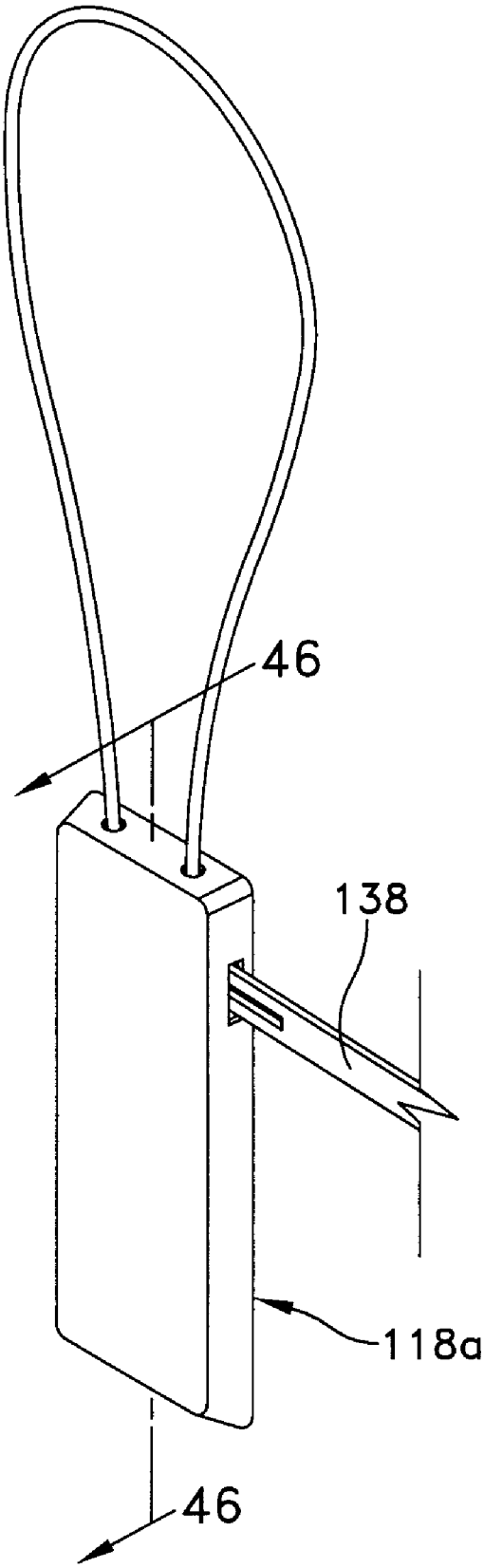
FIG. 45 is a perspective view of the anti-theft tag of FIG. 38 upon insertion of a crimping tool.
Figure 46:
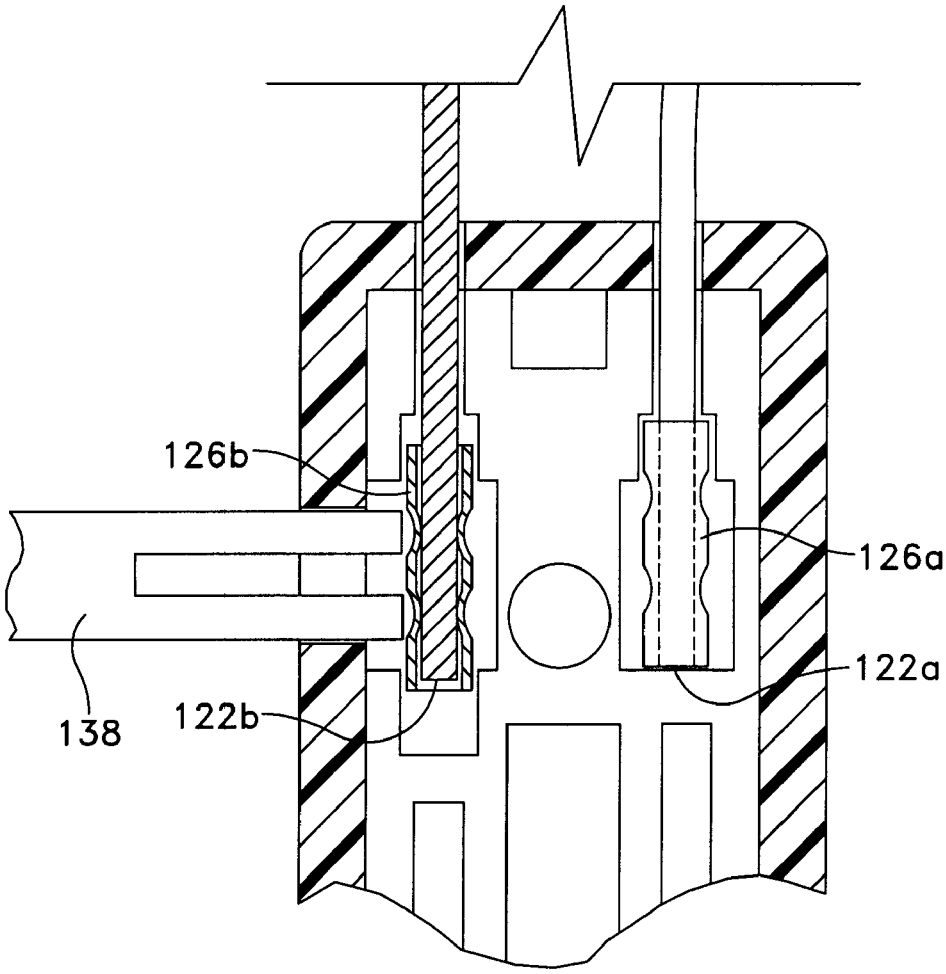
FIG. 46 is a cross sectional view taken along lines 46-46 of FIG. 45 illustrating crimping of the second end of the line.
Figure 47:
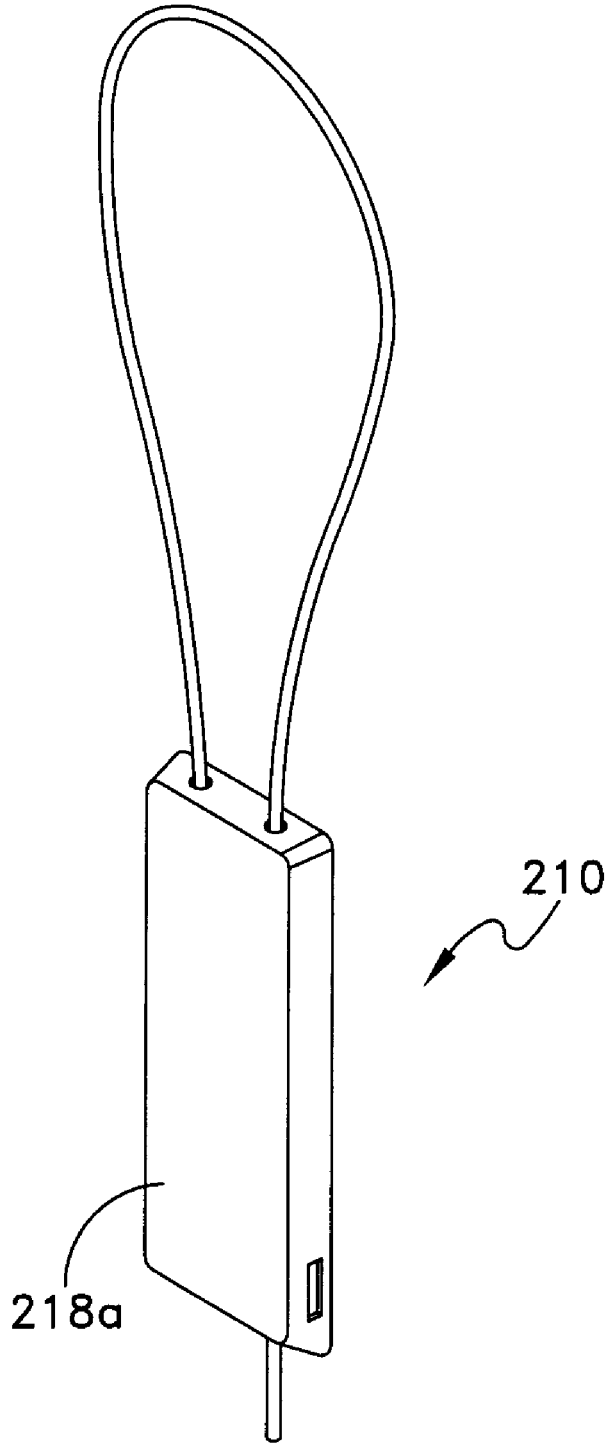
FIG. 47 is a front perspective view of an anti-theft tag in accordance with a sixth embodiment.
Figure 48:
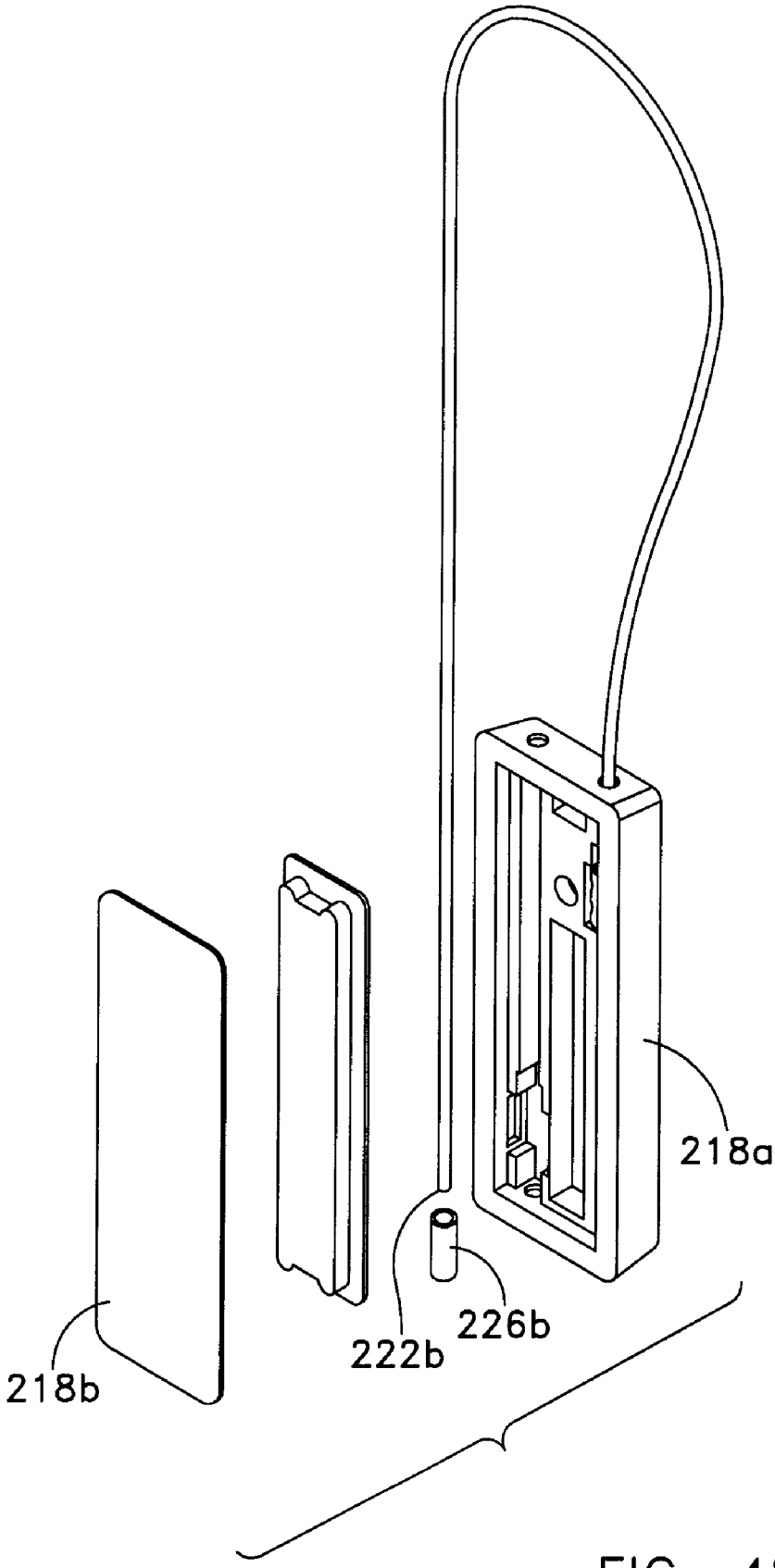
FIG. 48 is an exploded view of the anti-theft tag of FIG. 47.
Figure 49:
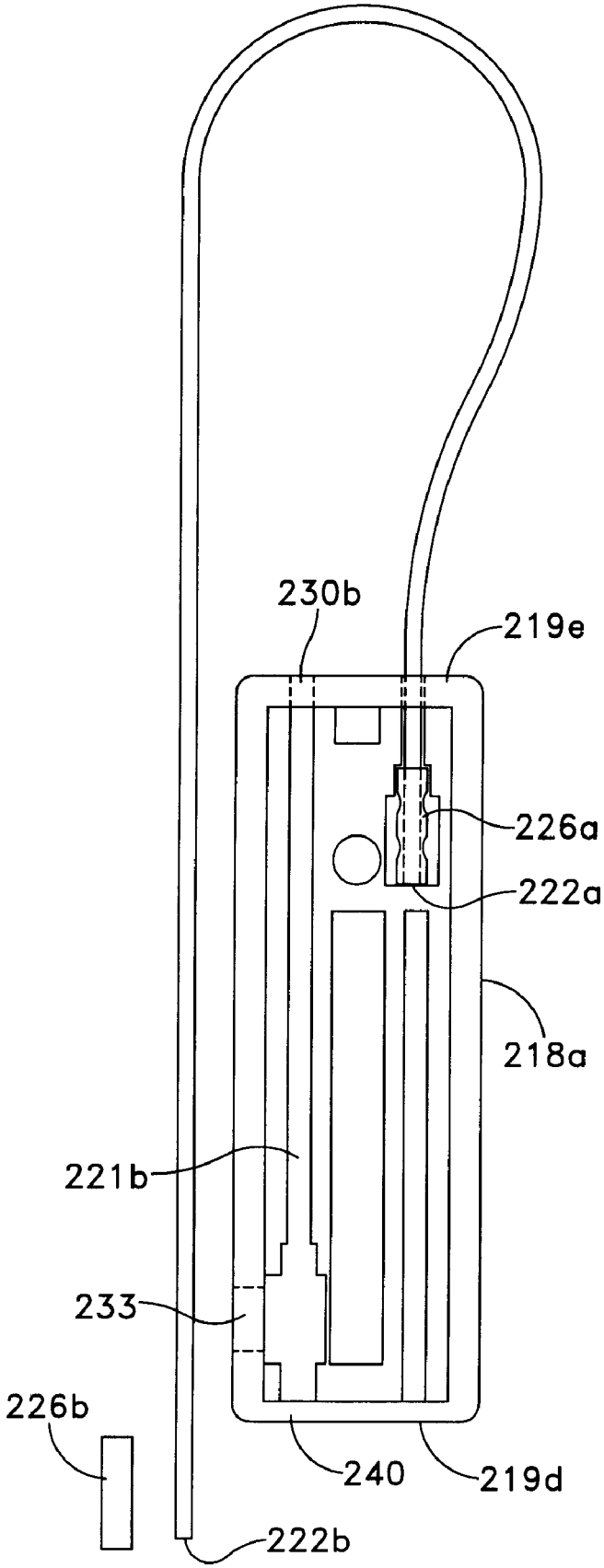
FIG. 49 is a top plan view of the anti-theft tag of FIG. 47 with the backing removed.
Figure 50:
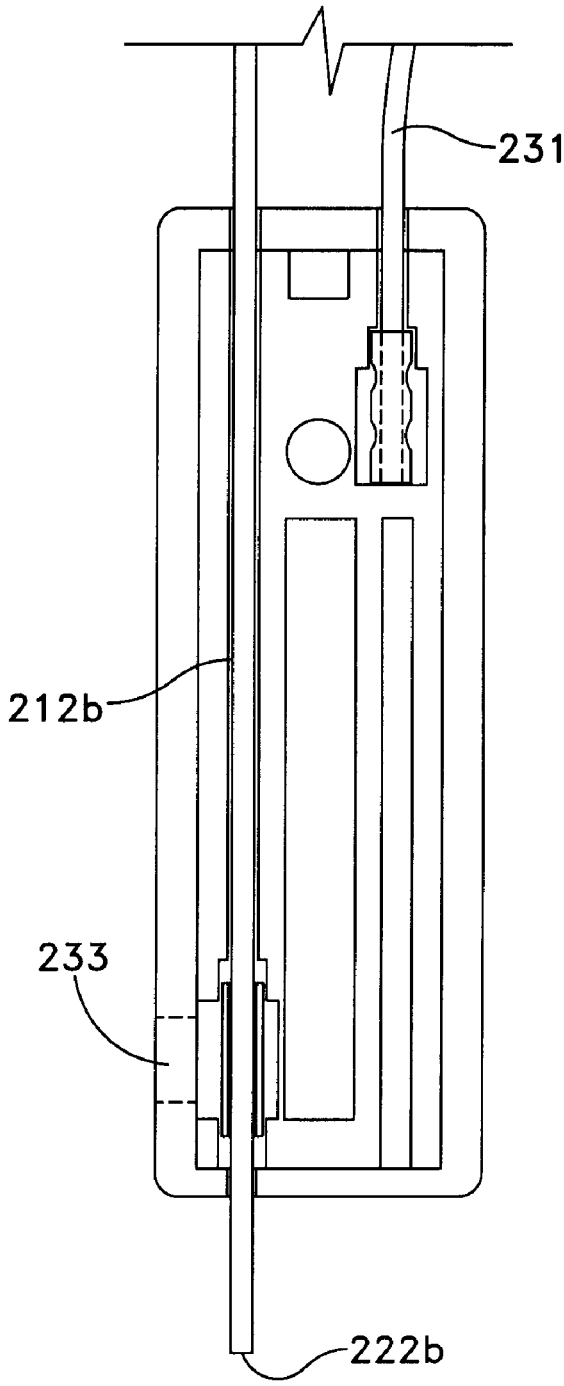
FIG. 50 is a top plan view of the anti-theft tag of FIG. 49 during insertion of a second end of the line.
Figure 51:
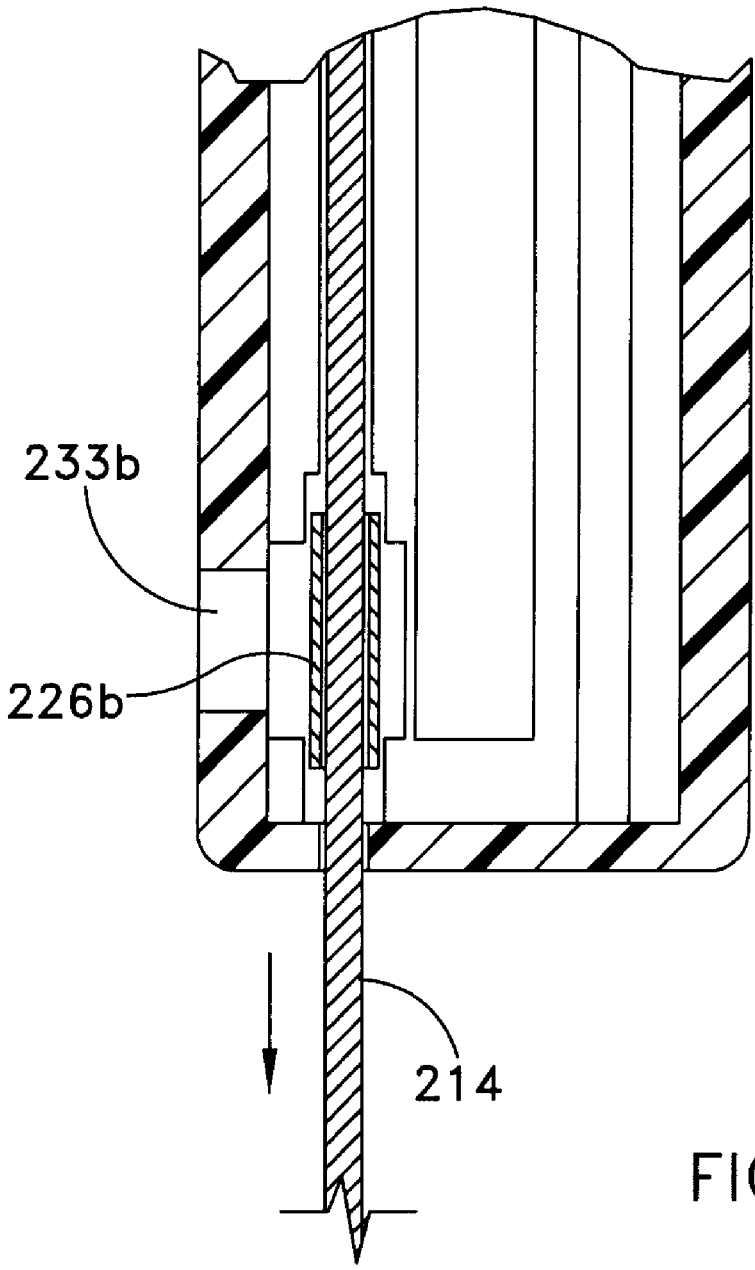
FIG. 51 is a cross sectional view of the second end of the line going through and exiting the housing.
Figure 52:
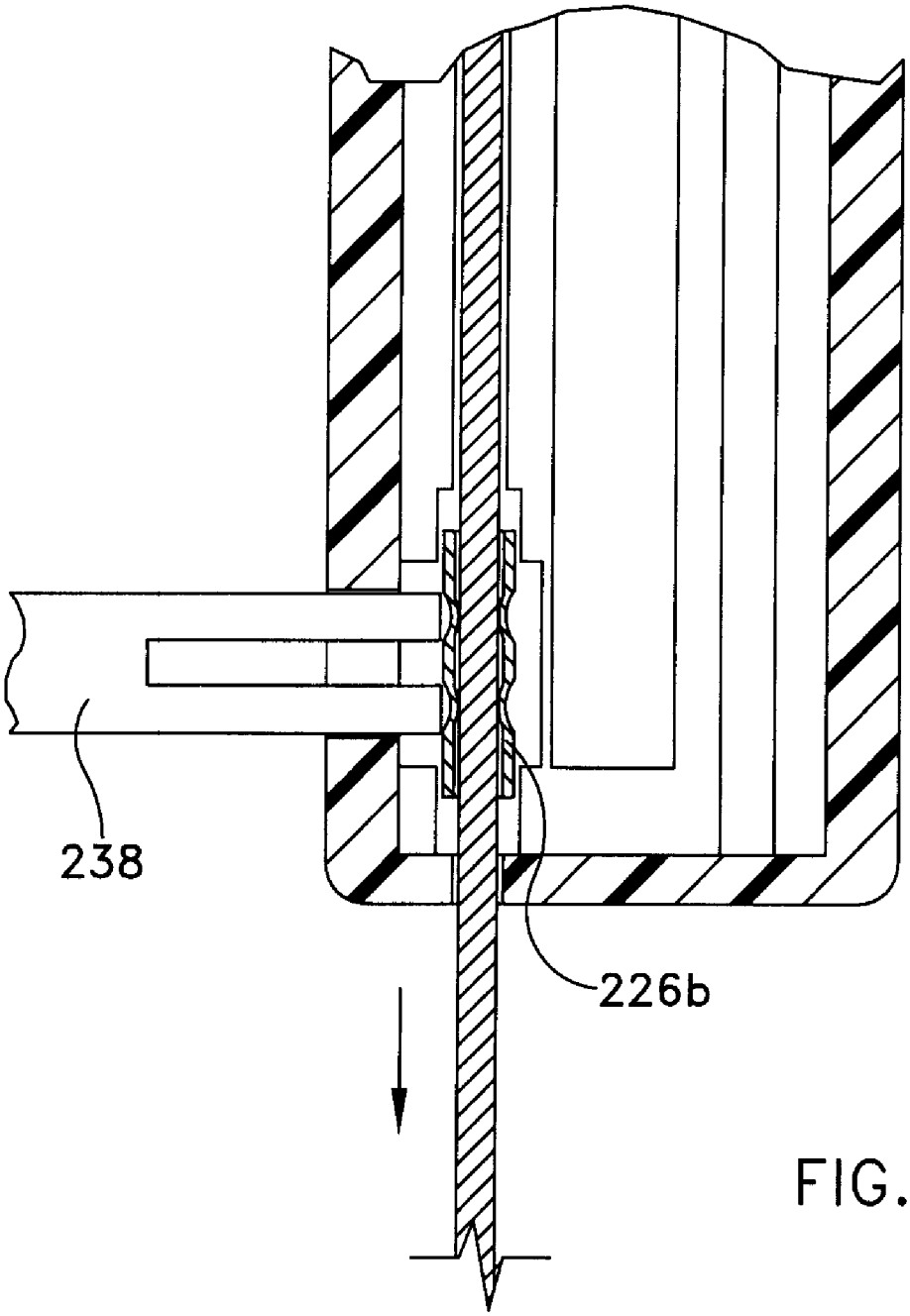
FIG. 52 is a cross sectional view upon insertion of a crimping tool illustrating crimping of the second end of the line.

Although the first, second and third embodiments illustrate an anti-theft tag in which the first end 22*a* is fixed within the housing 16, it is possible for both the first and second ends 22*a*, 22*b* to be insertable within the housing, for example by a user, and thereafter engaged by a crimping member. For example, both sets of channels 21*a*, 21*b* may be provided with corresponding ledges 29*a*, 29*b* each for supporting one or more crimping members 26. The first and second ends 22*a*, 22*b* could, thereafter be inserted into each of the corresponding channels until engaged by the crimping members. Alternatively, a single channel for receiving both the first and second ends 22*a*, 22*b* could be provided, as shown in a fourth embodiment illustrated in FIGS. 33-37. Again, the fourth embodiment operates in the same manner as the preceding three embodiments, with the exception that the first end 22*a* is not supported within the housing in a fixed manner prior to receipt by a consumer. In particular, the first and second ends 22*a*, 22*b* are separate from the housing until both the first and second ends are inserted within the single channel, 21 that is provided. As best illustrated in FIGS. 35-37, both ends of the line are inserted into a single hole 42, which may include a necked-down or funnel portion 43 that helps to guide both ends into the at least one crimping member 26. In this manner, both the first and the second end are engaged by the fingers of the crimping members in order to secure the engagement member around the article and to the housing 16. A potential advantage to having the both the first and seconds ends supported in this manner is that because the discs 26 are free to rotate in a clockwise or counterclockwise direction as they sit on the ledges, the loop 37 would also be free to rotate. Thus, a consumer would find it harder to apply a twisting force in an effort to break the loop 37 then if one end were fixed and not rotatable (in which case it would be easier to apply a twisting force).

Referring now to FIGS. 38-46, a fifth embodiment including a selectively crimped member is illustrated. In this embodiment, all parts which are the same, or similar to, corresponding parts in the first embodiment are noted with the same two last numbers, but preceded by the numeral "1". In this embodiment, tag 110 also includes an engagement member 114, and a housing 116 having a base 118*a* and a cover 118*b*. The base preferably includes a front wall 119*a*, side walls 119*b* and 119*c*, a bottom wall 119*d* and a top wall 119*e*, the walls bounding a cavity 120 formed in the base. The top wall 119*e* includes a pair of openings sized to receive a first end and a second end 122*a*, 122*b*, respectively, of the engagement member 114, the openings providing access to a pair of channels 121*a*, 121*b* disposed within the base.

In the fifth embodiment, the at least one crimping member 126*b* is disposed in channel 121*b* and is preferably cylindrical and sized to loosely fit around the free, second end 122*b* of the engagement member prior to crimping. The first end 122*a* of the engagement member 114 is preferably received through an opening 130*a* in the top wall 118*e* of the housing 118*a* and into the crimping member 126*a* disposed in channel 121*a*. The crimping member 126*a* is preferably crimped by the manufacturer, and is sized larger than the opening 130*a* so that the first end is secured within the housing 118*a* when received by a retail establishment. Although a channel is provided for the crimping member 126*a*, it is an optional feature and may be eliminated as would be known to one of skill in the art. The second end 122*b* of the line 1245 is preferably not crimped by the manufacturer so that the tag can be attached to the article at a later date, for example by a retailer. However, crimping member 126*b* is preferably held in place within channel 121*b*, in alignment with opening 130*b* and slot 133, which is sized to receive a crimping tool, as described in greater detail below. In the present embodiment, the crimping members 126*a*, 126*b* are pliant so that a crimping tool 128 engaging the members will force the members inward so as to crimp around the ends of the engagement member, as is known in the art.

A conventional EAS marker 112 is preferably placed over the crimping members 126*a*, 126*b* and is supported within the cavity 120 of the housing 118*a*. In the present embodiment, interior walls 132 aid in supporting the EAS marker and also define the channels 121*a*, 121*b*. The cavity 120 and walls 132 are preferably dimensioned so that the EAS marker is approximately flush with the perimeter of the walls 119*b*-119*e*. Once the EAS marker is in position, the cover 118*b* is secured to the housing 118*a*. In this manner, the EAS marker is hidden within the housing and is not readily accessible to the consumer. The cover may have any of a variety of forms, and is an adhesive-backed plastic sticker in the present embodiment.

Referring now to FIGS. 42-46, connection of the tag to an article, such as a watch band 113 is illustrated. Although the cover 118*b* is missing for purposes of illustration, in use the cover would be in place. To attach the anti-theft security tag, the second end 112*b* is inserted about the article, here through a hole 134 in the watch band, and into opening 130*b* so as to form loop 137. The second end 122*b* is then inserted into crimping member 126 disposed within channel 121*b*. The crimping member is in alignment with opening 130*b* so that the second end is easily received within the member. In the present embodiment, a portion 132*a* of interior wall 132 prevents the second end 122*b* from being over-inserted and also aids in retaining the crimping member. Slot 133 is sized to receive a crimping tool 138, and is disposed through side wall 119*b* in alignment with the side of the crimping member 126*b*. After the second end 122*b* is inserted within the crimping member 126, the crimping tool is inserted through the slot 133 and engages the member 126*b* in order to force the member inwardly so as to crimp it around the second end of the engagement member. Because the member 126*b* is sized larger than the opening 130*b*, even in the crimped state, the second end 122*b* is secured within the housing. Once the second end is crimped within the housing, the size of loop 137 is fixed, and the anti-theft tag is securely attached to the article.

Referring now to FIGS. 47-52, a sixth embodiment including an adjustable engagement member is illustrated. In this embodiment, all parts which are the same, or similar to, corresponding parts in the previous embodiments are noted with the same two last numbers, but preceded by the numeral "2". As illustrated, the anti-theft tag 210 is identical to tag 110 described above with respect to the fifth embodiment, with the exception of channel 221*b* and the addition of a third opening 223 disposed through bottom wall 219*d*. In this embodiment, channel 221*b* extends the length of the housing 218*a*, from opening 230*b* in top wall 219*e* down to opening 223 in bottom wall 219*d*. In addition, crimping member 226*b* may preferably be positioned adjacent the bottom wall 219*d*. Likewise, the slot 233 for receiving the crimping tool is also positioned adjacent the bottom wall 219*d*, in alignment with crimping member 226*b*. The remaining elements of the anti-theft tag 210 are the same as in the fifth embodiment, including the positioning of the first end 222*a* and crimping member 226*a* within the housing 218*a*.

Figure 33:
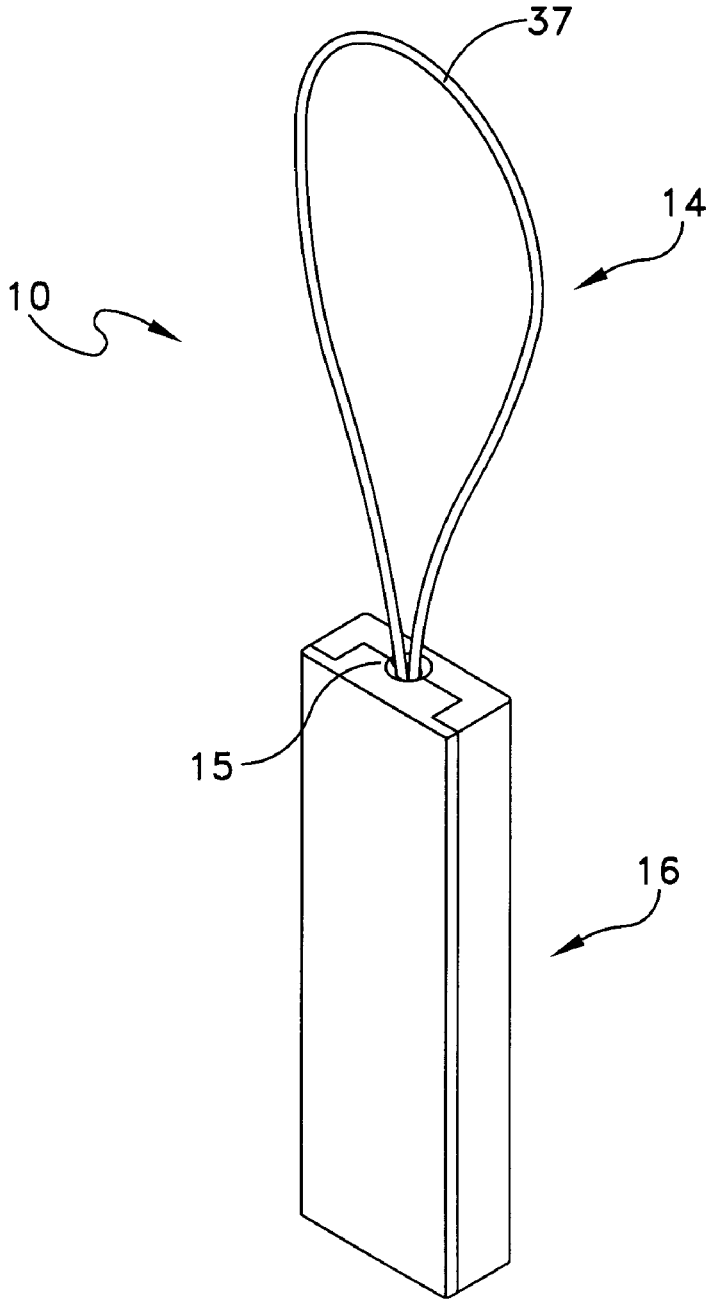
FIG. 33 is a front perspective view of an anti-theft tag in accordance with a fourth embodiment.
Figure 34:
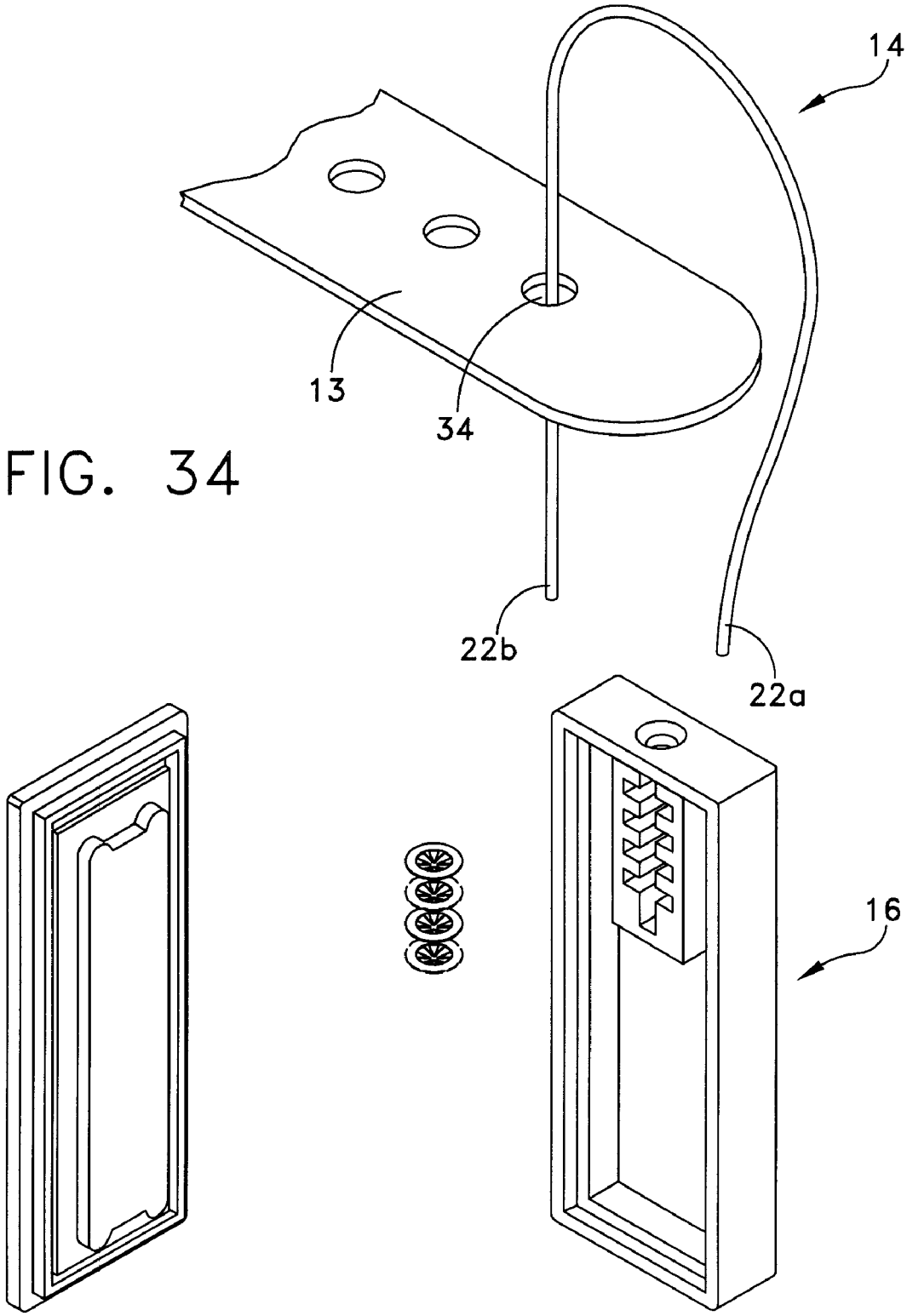
FIG. 34 is an exploded view of the anti-theft tag of FIG. 33.

By extending the channel the length of the housing 218*a*, from opening 230*b* in top wall 219*e* down to opening 223 in bottom wall 219*d* the second end 222*b* can pass entirely through the housing and out of opening 240 in bottom wall 219*d* (FIG. 33). In this manner, the size loop 231 is adjustable by increasing or decreasing the length of the line which exits the housing through opening 240. In use, the first end is first crimped, the EAS marker 212 is inserted and the cover 218*b* is attached, as described above with respect the first embodiment. The second end 222*b* is then passed through or around the article, through the first opening 230*b*, into channel 221*b*, through crimping member 226*b* and out of opening 223. The line continues to be fed through the opening 240 until loop 231 reaches the desired size. The member 226*b* is then crimped by applying the crimping tool 238 through slot 233, as described above to secure the tag and set the size of loop 231. After crimping, the portion of the line which extends from opening 223 may be cut, if desired.

It will be appreciated the anti-theft tag described herein is capable of being readily assembled, while being tamper resistant after assembly, and may be attached to a variety of articles, as desired.

It will be understood that various modifications may be made to the embodiments disclosed herein. For example, it should be understood that the crimping member may have alternate shapes than those disclosed, the channels may or may not be provided, that the cover may take any of a variety of forms and be attached to the housing in any known manner, and the line may be formed of alternate materials, for example nylon or other types of plastic. Also, although shown as rectangular, the housing may be other shapes, for example circular, in which case there would be more or less walls, depending upon the particular shape, as would be known to those of skill in the art. Therefore, the above description should not be construed as limiting, but merely as exemplifications of a preferred embodiment. Those skilled in the art will envision other modifications within the scope, spirit and intent of the invention.

What is claimed:

1. An anti-theft tag, comprising:

a housing configured to support an electronic article surveillance (EAS) marker;

a rotation member rotatably supported by the housing, the rotation member configured to capture at least a portion of a line to secure the anti-theft tag to an article;

wherein the rotation member is constructed and arranged to capture at least a portion of the line so as to form a loon exterior to the housing; and wherein the loon engages an article to secure the anti-theft tag to the article, the loon and housing being rotatable relative to each other.

2. The anti-theft tag of claim 1, comprising the line, at least a portion of the line being disposed within the rotation member.

3. The anti-theft tag of claim 2, wherein the rotation member defines an aperture, the at least a portion of the line being disposed within the aperture.

4. The anti-theft tag of claim 1, comprising the line having a first end and a second end opposing the first end, the rotation member being configured and arranged to receive the first end and the second end of the line.

5. The anti-theft tag of claim 4, wherein the rotation member comprises a securing member, the securing member being operable to secure the first end and the second end of the line.

6. The anti-theft tag of claim 1, wherein the rotation member comprises a securing member constructed and arranged to (i) initially hold a first end of the line in a pre-attached manner and allow a second end of the line to move freely in an un-captured manner while the securing member is capable of rotating relative to the housing, and (ii) subsequently capture the second end of the line in a manner that enables the first and second ends of the line to rotate relative to the housing while remaining captured by the securing member.

7. The anti-theft tag of claim 6, wherein the loop, the first end of the line, the second end of the line, and the rotation member are configured to rotate relative to the housing about an axis of rotation of the rotation member.

8. The anti-theft tag of claim 1, wherein the housing comprises a ledge disposed within the housing, the rotation member being supported by the ledge.

9. The anti-theft tag of claim 1, wherein the housing defines a cavity, the cavity having the EAS marker disposed therein.

10. An anti-theft tag, comprising:

a housing configured to support an electronic article surveillance (EAS) marker;

a line supported by the housing, the line having a first end and a second end opposing the first end, the line being constructed and arranged to form a loop relative to the housing to secure the anti-theft tag to an article, the first end and the second end of the line being rotatable relative to the housing; and a rotation member rotatably supported by the housing, the rotation member configured to capture a portion of the line;

wherein the rotation member is constructed and arranged to capture at least a portion of the line so as to form a loon exterior to the housing; and wherein the loon engages the article to secure the anti-theft tag to the article, the loon and housing being rotatable relative to each other.

11. The anti-theft tag of claim 10, wherein the rotation member defines an aperture, the at least a portion of the line being disposed within the aperture.

12. The anti-theft tag of claim 10, wherein the rotation member is configured and arranged to receive the first end and the second end of the line.

13. The anti-theft tag of claim 10, wherein the rotation member comprises a securing member, the securing member being operable to secure the first end and the second end of the line.

14. The anti-theft tag of claim 10, wherein the rotation member comprises a securing member constructed and arranged to (i) initially hold a first end of the line in a pre-attached manner and allow a second end of the line to move freely in an un-captured manner while the securing member is capable of rotating relative to the housing, and (ii) subsequently capture the second end of the line in a manner that enables the first and second ends of the line to rotate relative to the housing while remaining captured by the securing member.

15. The anti-theft tag of claim 14, wherein the loop, the first end of the line, the second end of the line, and the rotation member are configured to rotate relative to the housing about an axis of rotation of the rotation member.

16. The anti-theft tag of claim 10, wherein the housing comprises a ledge disposed within the housing, the rotation member being supported by the ledge.

17. The anti-theft tag of claim 10, wherein the housing defines a cavity, the cavity having the EAS marker disposed therein.

18. An anti-theft tag, comprising:

a housing configured to support an electronic article surveillance (EAS) marker;

a line constructed and arranged to secure the anti-theft tag to an article;

a rotation member rotatably coupled to the housing, the rotation member constructed and arranged to capture at least a portion of a line;

wherein the rotation member is constructed and arranged to capture at least a portion of the line so as to form a loon exterior to the housing; and wherein the loon engages the article to secure the anti-theft tag to the article, the loon and housing being rotatable relative to each other.

19. The anti-theft tag of claim 18, wherein the rotation member defines an aperture, the at least a portion of the line being disposed within the aperture.

20. The anti-theft tag of claim 18, wherein the rotation member comprises a securing member, the securing member being operable to secure the first end and the second end of the line.

21. The anti-theft tag of claim 18, wherein the rotation member comprises a securing member constructed and arranged to (i) initially hold a first end of the line in a pre-attached manner and allow a second end of the line to move freely in an un-captured manner while the securing member is capable of rotating relative to the housing, and (ii) subsequently capture the second end of the line in a manner that enables the first and second ends of the line to rotate relative to the housing while remaining captured by the securing member.

22. The anti-theft tag of claim 21, wherein the loop, the first end of the line, the second end of the line, and the rotation member are configured to rotate relative to the housing about an axis of rotation of the rotation member.

* * * * *